US005343881A

United States Patent [19]

Golan et al.

[11] Patent Number: 5,343,881

[45] Date of Patent: * Sep. 6, 1994

[54] HAIR TREATMENT APPARATUS AND METHOD

[76] Inventors: Zeev Golan; Ruth Golan, both of 9 Yair Stern Street, both of Herzliya; Shlomo Gilboa; Liora Gilboa, both of Kibbutz Glil Yam, Nr. Herzliya, all of Israel

[ * ] Notice: The portion of the term of this patent subsequent to Jan. 7, 2009 has been disclaimed.

[21] Appl. No.: 802,873

[22] Filed: Dec. 6, 1991

Related U.S. Application Data

[63] Continuation-in-part of Ser. No. 443,693, Nov. 30, 1989, Pat. No. 5,078,157.

[30] Foreign Application Priority Data

| | | | |
|---|---|---|---|
| Dec. 1, 1988 | [IL] | Israel | 88550 |
| Feb. 12, 1989 | [IL] | Israel | 89267 |
| Feb. 24, 1989 | [IL] | Israel | 89416 |
| Mar. 9, 1989 | [IL] | Israel | 89561 |
| Nov. 23, 1989 | [IL] | Israel | 92414 |

[51] Int. Cl.[5] ..... A45D 24/00

[52] U.S. Cl. ..... 132/119.1; 132/143; 132/200

[58] Field of Search ..... 134/112, 113, 114, 119.1, 134/124, 143, 144, 150, 152, 155, 120, 108, 129, 136, 142, 271; 15/22.1, 22.2

[56] References Cited

U.S. PATENT DOCUMENTS

| | | | |
|---|---|---|---|
| 2,206,365 | 7/1940 | Pieper | 132/152 |
| 2,479,253 | 9/1947 | Prediger | 132/119.1 |
| 3,204,469 | 5/1963 | Spillers | 132/119.1 |
| 3,252,175 | 10/1964 | Pedersen | 15/22 B |
| 3,272,023 | 11/1964 | Ferguson | 132/119.1 |
| 3,349,782 | 10/1967 | Sawin | 132/119.1 |
| 3,358,309 | 12/1967 | Richardson | 15/22 R |
| 3,384,096 | 5/1968 | Pacciona | 132/119.1 |
| 3,386,453 | 1/1969 | Roberts et al. . | |
| 3,421,522 | 2/1969 | Magguilli | 132/119.1 |
| 3,427,674 | 8/1969 | Tone et al. | 15/23 |
| 3,461,883 | 11/1969 | Maris | 132/119.1 |
| 3,474,795 | 2/1966 | Hantman | 132/119.1 |
| 3,701,354 | 10/1972 | May | 132/119.1 |
| 3,750,680 | 6/1972 | Miller | 132/119.1 |
| 3,782,395 | 1/1974 | Sarna | 132/212 |
| 3,794,050 | 5/1974 | Gallanis et al. | 132/119.1 |
| 3,840,030 | 5/1974 | Baker | 132/119.1 |
| 3,850,180 | 11/1974 | Rydemen, Jr. et al. | 132/119.1 |

(List continued on next page.)

FOREIGN PATENT DOCUMENTS

| | | |
|---|---|---|
| 2209831 | 10/1972 | Fed. Rep. of Germany . |
| 3604009 | 8/1987 | Fed. Rep. of Germany . |
| 1263225 | 5/1961 | France . |

OTHER PUBLICATIONS

K. A. Saunders, "Treatment of Head Lice", Pharmaceutical Journal, Sep. 1984.

J. W. Maunder, "Parasites and Man, Human Lice—Biology and Control", Journal of the Royal Society of Health, 1977.

*Primary Examiner*—Gene Mancene

*Assistant Examiner*—Frank A. LaViola

*Attorney, Agent, or Firm*—Cushman, Darby & Cushman

[57] ABSTRACT

Apparatus for treating hair including a handle; hair separation apparatus having a generally elongate base portion associated with the handle, and a plurality of parallel teeth attached to the base apparatus, and extending transversely therefrom, each tooth having a free end; and drive apparatus for oscillating the plurality of teeth at a frequency of no less than about 3,000 cycles per minute and for limiting a stroke of the free end of each the tooth to a length of no greater than approximately 8 mm, and for bringing the plurality of teeth into repeated engagement with a group of hairs attached to skin, thereby to ease passage of the hair separation apparatus through the group of hairs at a level of discomfort tolerable to a user.

17 Claims, 22 Drawing Sheets

U.S. PATENT DOCUMENTS

| | | | |
|---|---|---|---|
| 3,850,181 | 11/1974 | Baker | 132/119.1 |
| 3,853,133 | 12/1974 | Komatsu et al. | 132/119.1 |
| 3,863,652 | 8/1975 | Scivoletto | 132/119.1 |
| 3,870,056 | 11/1975 | Stemme | 132/119.1 |
| 3,894,547 | 12/1975 | Scivoletto | 132/119.1 |
| 3,897,794 | 12/1975 | Branch | 132/119.1 |
| 3,942,538 | 4/1976 | Deppeler | 132/119.1 |
| 3,964,502 | 6/1976 | Komatsu | 132/119.1 |
| 4,139,014 | 4/1977 | Rowland | 132/119.1 |
| 4,376,441 | 3/1983 | Duncan | 132/112 |
| 4,532,707 | 8/1985 | Allen | 30/200 |
| 4,612,944 | 9/1986 | Bachrach et al. | 132/159 |
| 4,612,945 | 9/1986 | Bachrach | 132/142 |
| 4,632,135 | 12/1986 | Lenting | 132/313 |
| 4,729,147 | 3/1988 | Armbruster | 15/314 |
| 3,894,5549 | 12/1975 | Scivoletto | 132/119.1 |

FIG. 4A
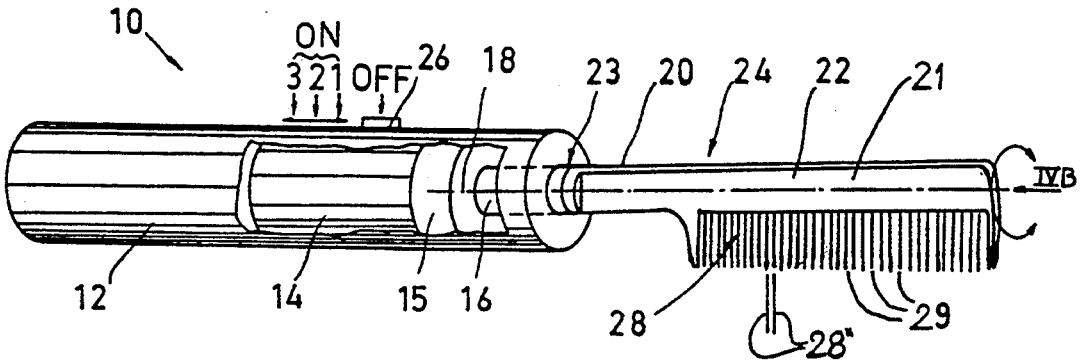
FIG. 4B
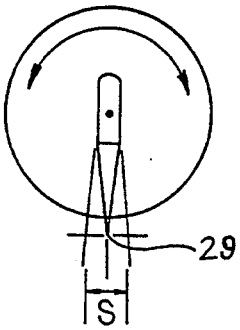
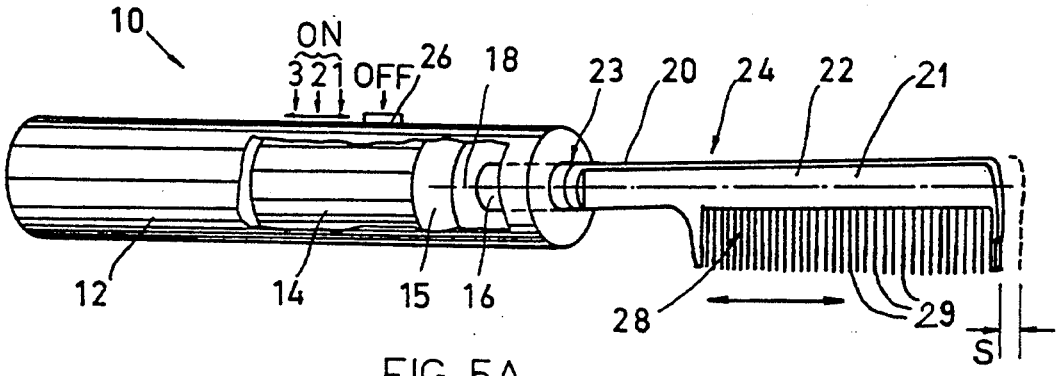
FIG. 5A

FIG.10
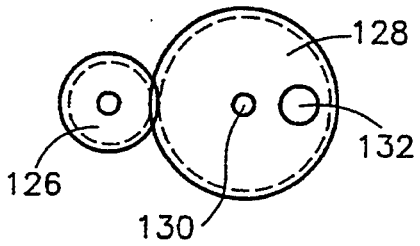
FIG.11
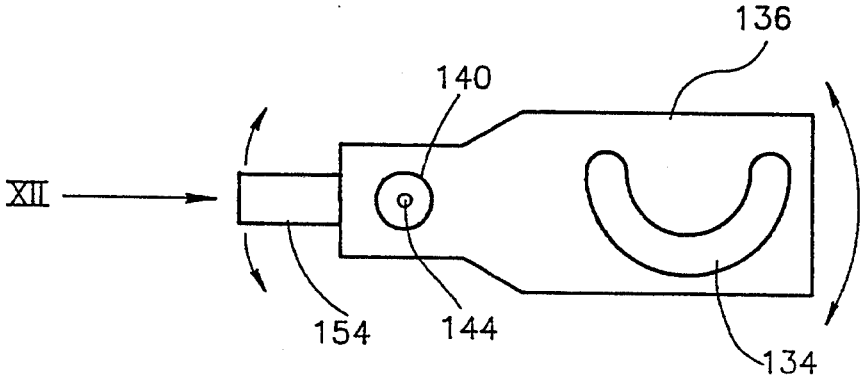
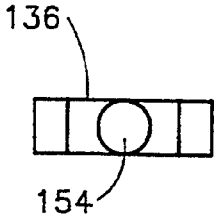
FIG.12
FIG.13
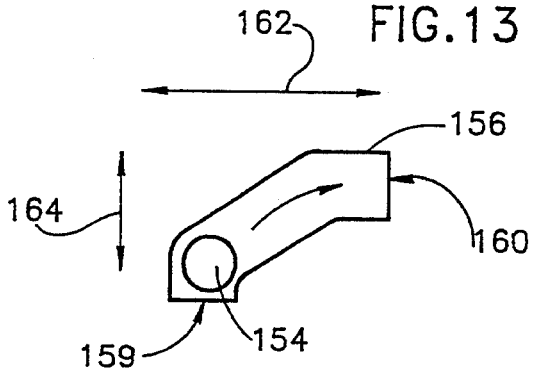
FIG.14
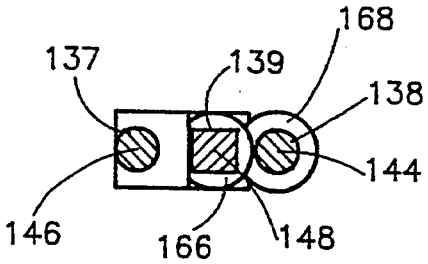
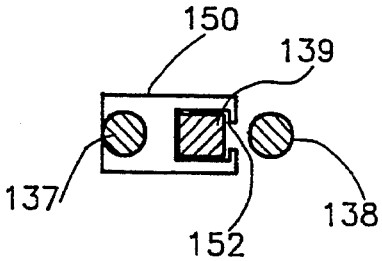
FIG.15

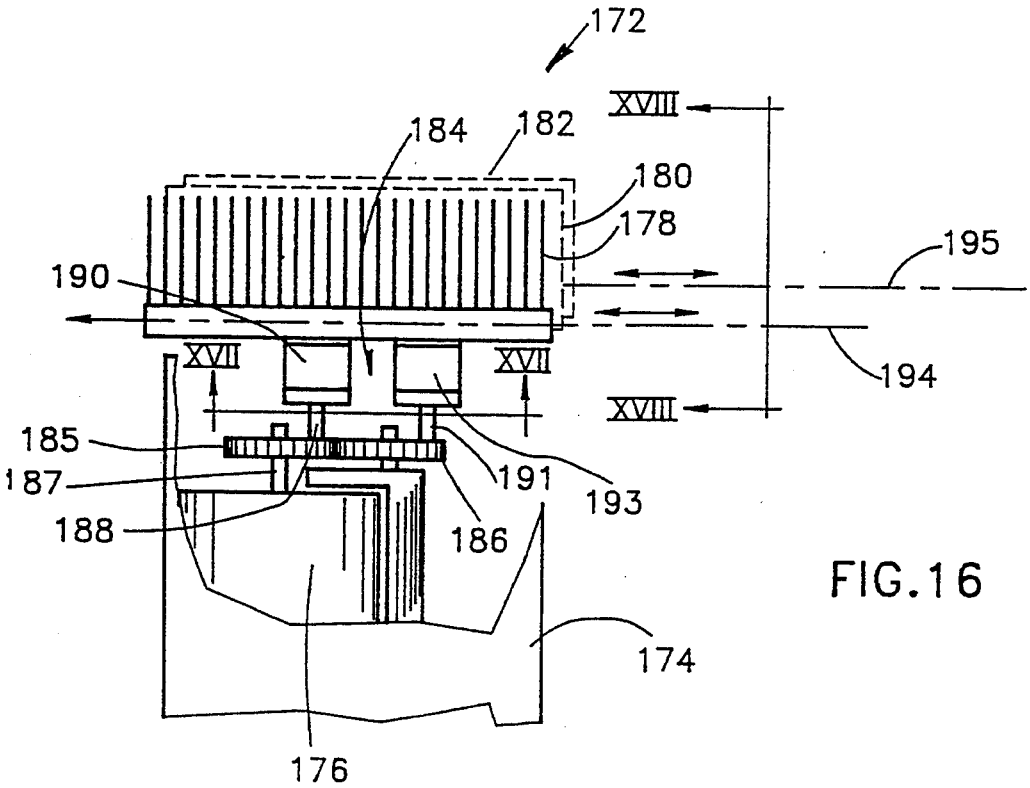
FIG. 16
FIG. 17
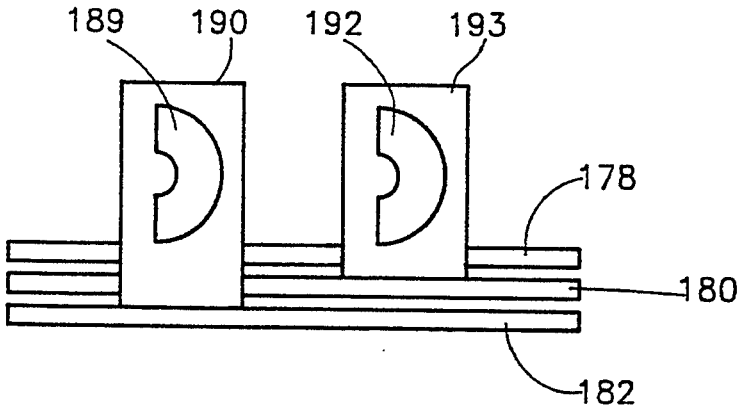
FIG. 18
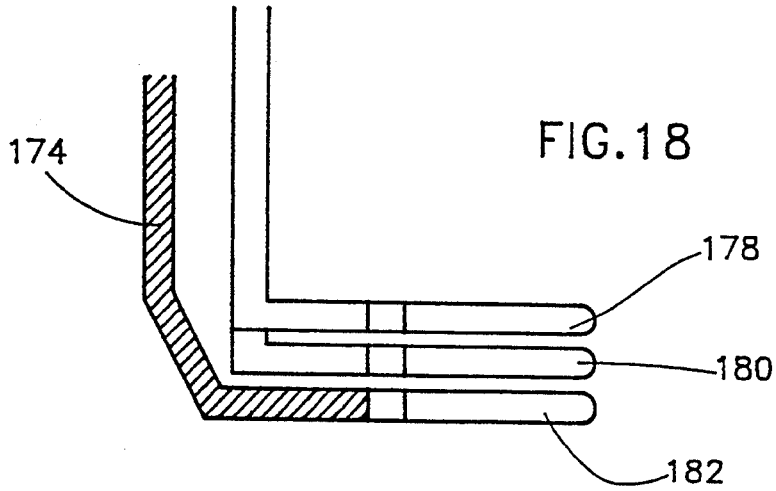

FIG.23
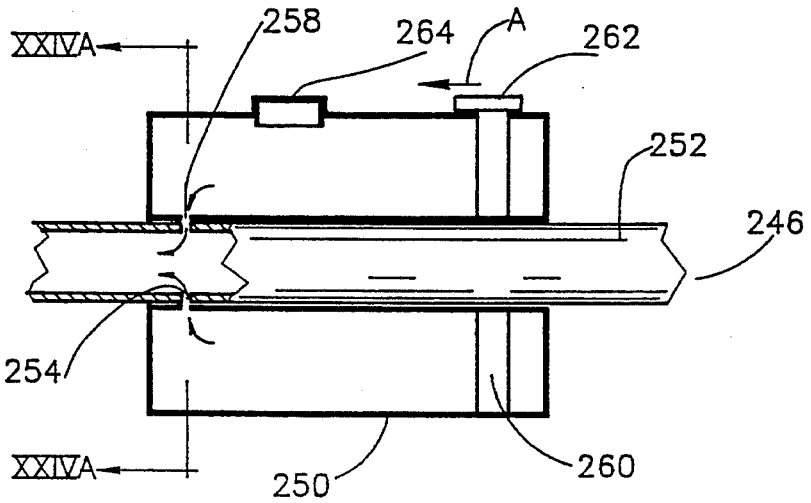
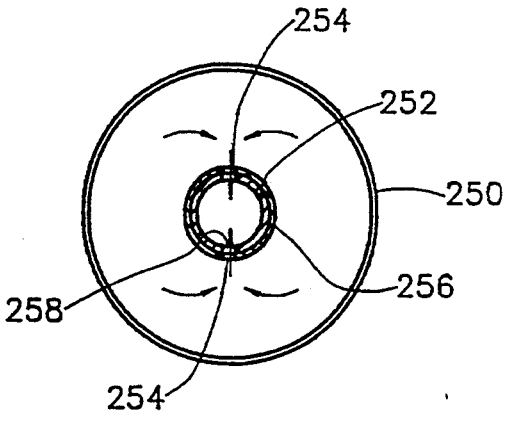
FIG.24A
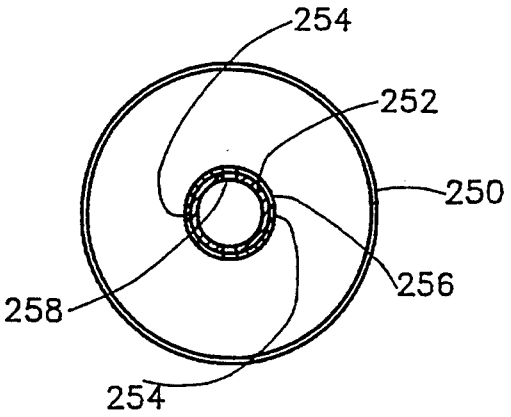
FIG.24B

FIG.35
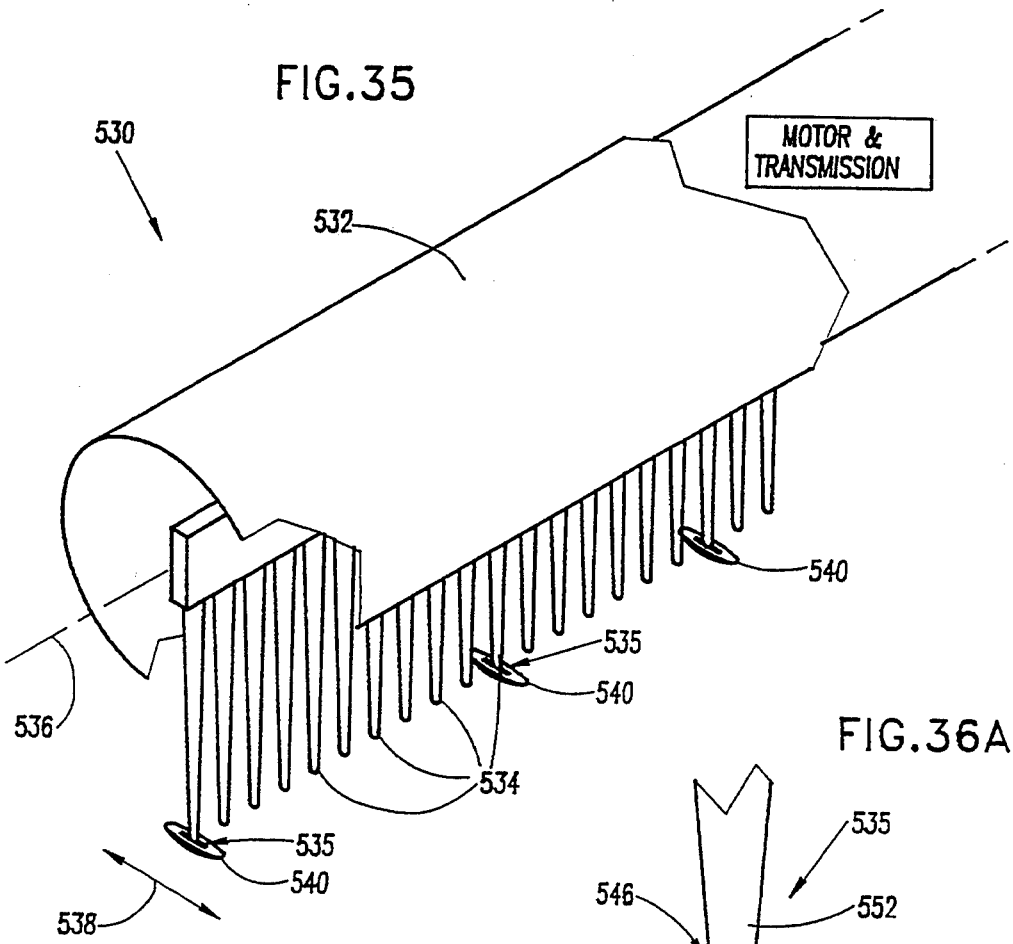
FIG.36A
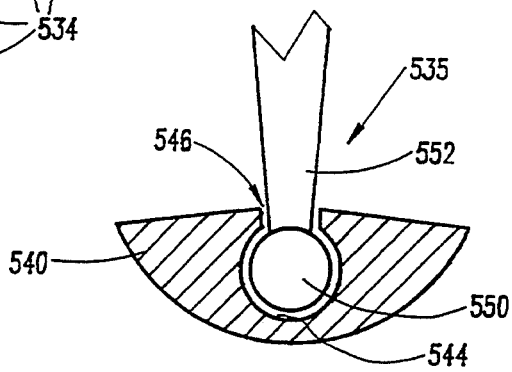
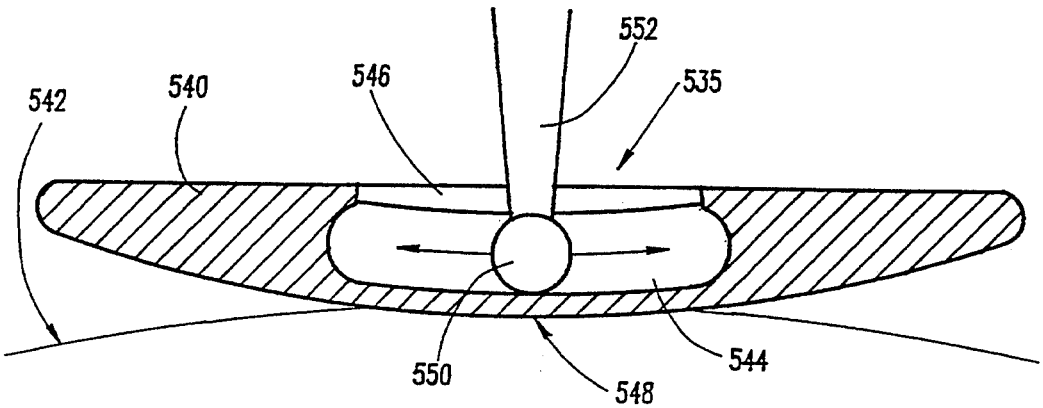
FIG.36B

HAIR TREATMENT APPARATUS AND METHOD

REFERENCE TO CO-PENDING APPLICATIONS

The present application is a continuation in part application of U.S. Ser. No. 07/443,693, filed Nov. 30, 1989, now U.S. Pat. No. 5,078,157 entitled OSCILLATORY HAIR TREATMENT APPARATUS AND METHOD.

FIELD OF THE INVENTION

The present invention relates to apparatus and methods for treatment of the hair.

BACKGROUND OF THE INVENTION

Many different types of powered devices are available for combing the hair, whether for grooming purposes or for purposes of treating hair and/or scalp conditions, such as removal of lice and dandruff.

Hantman et al U.S. Pat. No. 3,474,795 discloses a hair dressing device having an electric motor and drive mechanism releasably connected to a comb for rapidly oscillating the comb. The comb defines a relatively wide, elongate portion and a plurality of teeth extending transversely from the elongate portion.

The comb is arranged so as to be oscillated by the drive mechanism about an axis extending parallel to the elongate portion and also extending through the junction points of the teeth and the elongate portion, or through the teeth at a location somewhat spaced from the junction points.

As the comb is oscillated, no force is imparted to hairs it may be sought to separate along the axis, portions of the comb lying along the axis thus defining 'dead points', at which no work is done by the comb teeth. At a distance from the axis a force is, however, delivered by the teeth in proportion to the distance from the axis.

It will thus be appreciated that the device to Hantman et al is inefficient, as at least a portion of each tooth serves no useful purpose in freeing knots and tangles in the hair it engages.

Furthermore, the amplitude of oscillation of the teeth and thus the force delivered thereby is directly proportional to their perpendicular distance from the axis. Thus, in order to obtain even a relatively small amplitude of oscillation at a point on each tooth element relatively close to the axis, the amplitude of oscillation of the points furthest from the axis and thus the force delivered thereat is unacceptably large. Although no preferred amplitude, per se, is specified, the oscillation of the tooth ends is specified as being typically in the range 20° to 40°, while "... useful results may generally be obtained in the range 5° to 150° . . . ". It will be appreciated that as the degree of discomfort experienced by a user is dependent, inter alia, on the amplitude (in terms of the distance covered by a tooth end in a single oscillation), and not specifically on the arc through which the comb is oscillated, no preferred amplitude is, in fact, specified by Hantman et al.

Hantman et al employ a relatively low frequency of oscillation of between 100 and 4,000 cycles per minute.

As the scalp is a relatively sensitive portion of the skin, particularly when being struck at a relatively low frequency of oscillation of between 100 and 4,000 cycles per minute, as described in the patent to Hantman et al, use of the described device would be very uncomfortable.

Baker disclosed in U.S. Pat. No. 3,850,181 is a hair detangling device which has a pair of fixed combs spaced about an axis, and a movable comb which is aligned along the axis and is reciprocated therealong so as to derangle hair with which the combs are engaged, The teeth of the combs extend perpendicular to the axis and, in order to permit access of the movable member to the scalp, the teeth of the movable member are longer, and thus protrude beyond the teeth of the fixed combs so as to directly contact the scalp. A range of operating speeds of between 2,000–4,000 strokes per minute is specified.

U.S. Pat. Nos. 3,840,030 and 3,850,180 to Baker and Ryckman Jr. et al, respectively, describe comb structures similar to that described in Baker U.S. Pat. No. 3,840,181. The device of the '030 patent is described as being operated at a speed in the range 2,000–4,000 strokes per minute, similar to the '181 patent. The device of the '180 patent is described as being operated at a speed in the range 2,000–2,500 strokes per minute.

Disclosed in Paccione U.S. Pat. No. 3,384,096, is an oscillatory teasing comb comprising a housing having an annular portion at one end and a flat and open longitudinal portion extending for substantially the length of a comb and terminating in a raised portion. Means are provided for pivotally mounting the frame in the housing, on the inner face thereof, in order to permit an oscillating movement of the frame in the housing. A drive shaft is rotatably mounted relative to the housing having eccentric means on the drive shaft, and means for automatically selectively oscillating the drive shaft are provided, as well as a plate for operatively connecting the drive shaft with the frame for oscillating movement of the latter, and a teasing comb removably secured in the frame and joining the oscillating movement of the latter.

The teasing comb has a plurality of teeth spaced from an axis and operative to be oscillated thereabout. The spacing of each tooth from the axis is relatively small, however, being approximately one-tenth of the length of a tooth, and does not provide a satisfactory solution to the 'dead point' described above in connection with the device of Hantman et al. Furthermore, Paccione does not disclose a preferred amplitude to oscillation of the comb about the axis nor does he disclose a preferred frequency of oscillation.

Maris U.S. Pat. No. 3,461,883, entitled POWER COMB, describes a handle, a comb and motive means. In one embodiment, the comb is positioned at right angles to the motive means, and is associated therewith via a transmission, the resultant motion being a combination of a linear motion, perpendicular to the comb, and a parallel, circular motion of the comb. No preferred operating speed is specified.

Komatsu et al U.S. Pat. No. 3,853,133, entitled COMBINED HAIR DRYER AND DETANGLER and Komatsu U.S. Pat. No. 3,964,502, entitled COMBINED HAIR STYLER AND DETANGLER, describe similar devices, each having a handle, a housing attached to the handle, and apparatus, associated with the housing, for counter-reciprocating a pair of parallel hair combs along their longitudinal axes. A preferred stroke length is in the range 0.76–3.30 mm, and a preferred operating speed is in the range 6,000–9,000 cycles per minute.

German Patent No. 36 04 009 is directed to a power driven hair combing device. The device includes a handle, a comb and a drive for oscillating the comb in a back-and-forth motion along its longitudinal axis. No preferred operating conditions are specified.

French Patent No. 1,263,225 to Peyron discloses a device for cleaning a head of hair. The device comprises an oscillating disc having a set of teeth (oscillating teeth) protruding at right angles therefrom, and a planar, circular, sponge-like member through which the teeth extend so as no protrude therebeyond. As cleaning of hair requires contact thereof with the sponge-like member, the oscillating teeth protrude beyond the sponge-like member by a short distance, typically about 3–4 mm. The oscillating disk is mounted onto a housing for oscillation about an axis extending perpendicular to the disk. Operation of the device in association with a head of hair causes removal of dirt therefrom.

Two diametrically positioned, mutually perpendicular lines of fixed teeth, attached to the housing and extending through suitable openings in the oscillating disk and in the sponge-like member, extend parallel to and beyond the oscillating teeth. The fixed teeth are intended to support the device on the scalp, and thereby prevent contact between the oscillating teeth and the scalp. As the oscillatory motion is about an axis that is perpendicular to the disk and parallel to the teeth, the oscillating teeth nearest the oscillation axis experience very little movement, while the oscillating teeth furthest from the oscillation axis experience a relatively large movement.

The fixed and oscillating teeth of the described device are configured for entry into a head of hair, until further entry into the hair is prevented, depending on the thickness of the hair, either by engagement of the fixed teeth with the scalp, or by engagement of the hair by the sponge-like member. As the disk and sponge-like member are rotated, adjacent hairs and dirt cling to the sponge-like member. Although such motion is useful when seeking to remove dirt, it actually hinders hair separation, being contrary to the type of motion required for the separation of hairs.

The device described includes fixed teeth. While these fixed teeth extend beyond the oscillating teeth in a direction parallel thereto, they do not provide an efficient means of protection of the scalp from the oscillating teeth. This is mainly due to the circular arrangement of the oscillating teeth, and to the provision of the fixed teeth in two mutually perpendicular lines.

In particular, in order to prevent the scalp from being struck by the oscillating teeth, they need to be diametrically aligned with a line of fixed teeth. If they are not aligned, given that the scalp is a rounded surface, tilting the device, even at a small angle, will bring the oscillating teeth into engagement with the scalp. The majority of oscillating teeth are never diametrically aligned with a line of teeth, and even those teeth that, when the device is at rest, are aligned with the fixed teeth, move into and out of alignment therewith when they are oscillated. Accordingly, the fixed teeth provide very limited protection to the scalp.

If a mass of hair engaged by the hair cleaning device is of more than a predetermined thickness, such that the protrusion of the fixed teeth beyond the oscillating tooth is not sufficient so as to penetrate through to the scalp, the oscillating sponge-like member and the oscillating teeth become engaged in the mass of hair. The mass of hair is thus operative to conduct the oscillatory motion of the sponge-like member and the oscillating teeth directly to the hair and from there, to the scalp. The result is thus somewhat like a scalp massage, this being described in the cited document as being a beneficial result produced by use of the device. Accordingly, even if the hair cleaning device is used in such a manner that the oscillating teeth do not strike the scalp, the fixed teeth nonetheless provide only limited protection to the scalp.

The following references describe various additional electrically powered hair treatment devices.

U.S. Pat. No. 2,479,253, entitled VIBRATORY COMBING AND MASSAGING DEVICE, describes a device having handle, one or two combing or massaging elements attached to the handle, and a motor for vibrating the one or two combing or massaging element longitudinally. Neither the speed of vibration nor the amplitude of vibration is specified.

U.S. Pat. No. 3,204,469, entitled POWER OPERATED TEASING COMB HAVING AN ELLIPTICAL PATH OF MOVEMENT, describes a teasing comb having a handle, an elongate comb attached via an end thereof to the handle, and motive means. The motive means is operative to rotate the comb through an elliptical or circular path relative to an axis.

U.S. Pat. No. 3,272,023, entitled POWER DRIVEN APPARATUS FOR OPPOSITELY RECIPROCATING A PAIR OF SPACED MEMBERS, describes apparatus having a handle, a pair of parallel comb members, and apparatus for driving the comb members in counter reciprocating fashion.

U.S. Pat. No. 3,421,522, entitled HAIR TEASING DEVICE, describes a device having a handle, a hair teasing element, and means for reciprocally oscillating the hair teasing element about an axis extending therethrough.

U.S. Pat. No. 3,701,354, entitled POWER ACTUATED HAIR TEASING APPARATUS WITH FLEXIBLE POWER DRIVE, describes a device having a handle, a teasing comb, and motive means for reciprocating the teasing comb along its longitudinal axis, relative to the handle.

U.S. Pat. No. 3,782,395, entitled HAIR TEASER, describes an electrically operated hair teasing device having a handle, a teasing comb, and motive means for producing a side-to-side rocking motion of the teasing comb relative to the handle.

U.S. Pat. No. 3,870,056, entitled HAIR DETANGLING DEVICE, describes an electrical hair detangling device employing a pair of counter-reciprocating combs or brushes.

U.S. Pat. No. 4,139,014, entitled COMBINATION HAIR STYLING/HAIR CURLING DEVICE, describes a styling comb/styling implement having a handle, a motor, a heat source, and a pair of counter-reciprocating combs.

The following references are also noted as teaching hair treatment apparatus:

U.S. Pat. No. 2,206,365, entitled HAIR DRESSING COMB;

U.S. Pat. No. 3,252,175, entitled ELECTRICALLY OPERATED HAIR BRUSH;

U.S. Pat. No. 3,349,782, entitled HAIR STYLING COMB WITH DRIVING MEANS;

U.S. Pat. No. 3,358,309, entitled CORDLESS VIBRATING ELECTRIC HAIR BRUSH, OR LIKE VIBRATING MANIPULATIONS;

U.S. Pat. No. 3,427,674, entitled ELECTRIC HAIR BRUSH;

U.S. Pat. No. 3,750,680, entitled TEASING COMB;

U.S. Pat. No. 3,863,652, entitled ELECTRICALLY DRIVEN HEATED HAIR CURLING OR SETTING DEVICE;

U.S. Pat. No. 3,894,547, entitled HAIR STYLING APPARATUS;

U.S. Pat. No. 3,894,549, entitled ELECTRICALLY DRIVEN AND HEATED HAIR TREATING DEVICE;

U.S. Pat. No. 3,897,794, entitled GROOMING IMPLEMENT;

U.S. Pat. No. 4,376,441, entitled HAIR TREATMENT APPLICATOR;

U.S. Pat. No. 4,532,707, entitled ANIMAL HAIR SHEAR AND CUTTING DEVICE;

U.S. Pat. No. 4,632,135, entitled HAIR GROOMING MEANS;

U.S. Pat. No. 4,729,147, entitled PET GROOMER AND FLEA ANNIHILATOR; and

German Patent No. 22 09 831, entitled ELECTRICALLY DRIVEN BACK-COMBING DEVICE WITH A SINGLE COMB.

There are available a number of different types of treatment for the removal of parasites, such as lice, that live in human hair. Among these treatments are chemical treatments such as special types of shampoo and mechanical treatments provided by purpose-made combs. These are often used in combination.

Combing the hair as a means of killing and/or removing lice from the hair is discussed in an article by K. A. Saunders, BPharm, MPS, entitled 'Treatment of Head Lice', published in *The Pharmaceutical Journal*, issue date Sep. 22, 1984. In the article, it is stated that the head louse cannot recover from injury, loss of a leg being fatal injury to the head louse. The author further recommends that regular thorough grooming of the hair with a comb is, therefore, the best way to prevent infestation with head lice. A similar statement is made in an article by J. W. Maunder, MSc, BSc, entitled 'Parasites and Man, Human Lice—Biology and Control', published in the *Journal of the Royal Society of Health* in 1977.

Disclosed in Bachrach and Teale U.S. Pat. No. 4,612,944 and in Bachrach U.S. Pat. No. 4,612,945, is a comb for removing lice and nits from the hair. The comb comprises a base and a plurality of teeth extending from the base in substantially the same direction. The longitudinal axes of the tooth are parallel to each other. Each tooth has a polygonal cross section shape, this being a diamond shape in the patent to Bachrach and Teale and a triangle shape in the patent to Bachrach. The cross-sectional dimensions of each tooth enlarge from the free end thereof toward the base so that the spacing between adjacent teeth narrows toward the base. The facing edges of adjacent teeth interact with each other to capture, in a scissor-like manner, lice and nits therebetween.

Among disadvantages of the recommended conventional combing and use of the comb to Bachrach and Teale and to Bachrach, is that individual hairs tend to become tightly knotted together or stuck together and thorough combing of the hair may, therefore, be extremely painful and, consequently, difficult to carry out efficiently.

SUMMARY OF THE INVENTION

The present invention seeks to provide hair treatment apparatus and methods of hair treatment overcoming disadvantages of known art.

There is provided, therefore, in accordance with an embodiment of the invention, apparatus for treating hair including, a handle; hair separation apparatus including generally elongate base apparatus associated with the handle, and a plurality of parallel teeth attached to the base apparatus and extending transversely therefrom, each tooth having a free end; and drive apparatus. The drive apparatus is operative to oscillate the plurality of teeth at a frequency of no less than about 3,000 cycles per minute, limit a stroke of the free end of each tooth to a length of no greater than approximately 8 mm, and bring the plurality of teeth into repeated engagement with a group of hairs attached to skin, thereby to ease passage of the hair separation apparatus through the group of hairs at a level of discomfort tolerable to a user.

According to a preferred embodiment of the invention, the drive apparatus includes apparatus for oscillating the hair separation apparatus at a frequency typically no less than approximately 3,000 cycles per minute, and preferably no less than approximately 4,750 cycles per minute.

According to a further embodiment of the invention, there is provided apparatus for treating hair including a handle; hair separation apparatus associated with the handle and extending along a longitudinal axis, and including generally elongate base apparatus arranged along the axis, and a plurality of elongate teeth attached to the base apparatus and oriented transversely to the longitudinal axis; and apparatus for imparting to the hair separation apparatus an oscillatory motion having a linear component along the longitudinal axis and further having a rotational component about the longitudinal axis, and for bringing the hair separation apparatus into repeated engagement with a group of hairs, thereby easing passage of the hair separation apparatus through the group of hairs.

In accordance with an additional embodiment of the invention, there is provided apparatus for treating hair including a handle; hair separation apparatus including generally elongate base apparatus associated with the handle and having a first longitudinal axis; and a plurality of parallel teeth attached to the base apparatus, each tooth having a second longitudinal axis transverse to the first longitudinal axis, each tooth further having a free end; and apparatus for oscillating each tooth. The apparatus for oscillating is operative to oscillate each tooth in a direction transverse to the first and second longitudinal axes, between first and second orientations at respective first and second extreme positions, wherein the first and second orientations are mutually parallel, and bring the plurality of teeth into repeated engagement with a group of hairs attached to skin, thereby to ease passage of the plurality of teeth through the group of hairs.

In accordance with yet a further embodiment of the invention, there is provided apparatus for treating hair including a handle; hair separation apparatus associated with the handle and extending along a longitudinal axis, and including generally elongate base apparatus arranged along the longitudinal axis, and a plurality of elongate teeth attached to the base apparatus and oriented transversely to the longitudinal axis; apparatus for imparting to the hair separation apparatus an oscillatory motion having a component along the longitudinal axis, and for bringing the hair separation apparatus into repeated engagement with a group of hairs, thereby easing passage of the hair separation apparatus through the group of hairs; and apparatus extending parallel to and having a portion spaced from the hair separation apparatus for substantially preventing the hair separation apparatus from striking skin to which the hairs are attached when the hair separation apparatus is substantially close to the skin.

There is also provided, in accordance with an embodiment of the invention, apparatus for treating hair including a housing; hair separation apparatus including generally elongate base apparatus associated with the housing, and a plurality of parallel teeth attached to the base apparatus and extending transversely therefrom, each tooth having a free end; and drive apparatus. The drive apparatus is arranged within the housing and is operative to oscillate the plurality of parallel teeth within a predetermined area, and bring the plurality of parallel teeth into repeated engagement with a group of hairs so as to ease passage of the plurality of parallel teeth therethrough. The hair treatment apparatus further includes a plurality of static, spaced apart tooth-like protrusions associated with the housing, extending beyond an area of movement of the plurality of parallel teeth and defining free ends configured for engagement with skin to which the group of hairs is attached, so as to substantially prevent the plurality of parallel teeth from striking the skin when the plurality of parallel teeth is substantially close to the skin; and static cushion apparatus, mounted onto the free ends of the tooth-like protrusions, for preventing transmission of vibrations from the drive apparatus, via the housing and the tooth-like protrusions, to the skin.

According to an additional embodiment of the invention, there is provided apparatus for treating hair including a handle; hair separation apparatus which includes generally elongate base apparatus associated with the handle, and a plurality of parallel teeth attached to the base apparatus and extending transversely therefrom, each tooth having a free end; apparatus for oscillating the plurality of parallel teeth and for bringing the plurality of parallel teeth into repeated engagement with a group of hairs so as to ease passage of the separation apparatus therethrough; and apparatus, mounted onto the free ends of two or more spaced apart teeth of the plurality of teeth, for substantially preventing the plurality of parallel teeth from striking skin to which the group of hairs is attached when the plurality of parallel teeth is substantially close to the skin.

According to the present embodiment of the invention, the apparatus for substantially preventing striking includes two or more spacer elements, each mounted onto one of the two or more spaced apart teeth.

Further in accordance with the present invention, each spacer element includes an elongate generally hollow member having an elongate skin engagement portion and an elongate opening, the opening having a width of a first magnitude and being configured for engagement with one of the two or more spaced apart teeth such that the free end thereof extends into the opening of the hollow member, the free end having a width of a second magnitude, smaller than the first magnitude, so as not to become fixedly attached to the spacer element when engaged therewith, such that when the hair separation apparatus is introduced into a group of hairs and the skin engagement surface of each spacer element is placed on skin associated with the group of hairs, oscillation of the hair separation apparatus does not cause a similar oscillation of the spacer elements.

In accordance with a further embodiment of the invention, there is provided apparatus for treating hair including a handle; hair separation apparatus associated with the handle, extending along a first axis, and further extending in a direction parallel to a second axis transverse to the first axis: and apparatus, associated with the handle, extending beyond the hair separation apparatus, in a direction parallel to the second axis, for substantially preventing contact between the hair separation apparatus and skin to which hairs are attached, when the hair separation apparatus is substantially close to the skin.

According to the present embodiment of the invention, the apparatus for substantially preventing contact may either be configured for mounting onto the handle, or may be configured for mounting onto the hair separation means.

In accordance with a preferred embodiment of the invention, the hair separation apparatus is a lice comb.

In accordance with yet a further embodiment of the invention, there is provided a method of treating hair including the steps of providing hair separation apparatus including a generally elongate base and a plurality of parallel teeth attached to the base and extending transversely therefrom, each tooth having a free end; oscillating the hair separation apparatus at a frequency of no less than 3,000 cycles per minute and so as to provide a stroke of the free ends of the teeth of length no greater than approximately 8 mm; placing the hair separation in a group of hairs, each having a length in a given direction; and moving the hair separation apparatus through the hairs in a direction generally transverse to the length of the hair, thereby easing passage of the hair separation apparatus through the hairs at a level of discomfort tolerable to a user.

Further in accordance with the present embodiment, the step of oscillating includes the step of oscillating the hair separation apparatus at a frequency typically no less than about 4,000 cycles per minute, and preferably no less than 4,750 cycles per minute.

There is also provided, in accordance with an embodiment of the invention, a method of treating hair including the steps of providing hair separation apparatus including a generally elongate base having a longitudinal axis, and a plurality of elongate teeth attached to the base and oriented transversely to the longitudinal axis; imparting to the hair separation apparatus an oscillatory motion having a linear component along the longitudinal axis and further having a rotational component about the longitudinal axis; placing the hair separation apparatus in a group of hairs, each having a length in a given direction; and moving the hair separation apparatus through the hairs in a direction generally transverse to the length of the hair, thereby easing passage of the hair separation apparatus therethrough.

According to an additional embodiment of the invention, there is provided a method of treating hair including the steps of providing hair separation apparatus having a generally elongate base defining a first longitudinal axis, and further having a plurality of parallel teeth each attached to the base and extending transversely therefrom along a second longitudinal axis, each tooth having a free end; imparting an oscillatory motion to each tooth, in a direction transverse to the first and second longitudinal axes, between first and second orientations at respective first and second extreme positions, wherein the first and second orientations are mutually parallel; placing the hair separation apparatus in a group of hairs, each having a length in a given direction; and moving the hair separation apparatus through the hairs in a direction generally transverse to the length of the hair, thereby easing passage of the hair separation apparatus through the hairs.

In accordance with a further embodiment of the invention, there is provided a method of treating hair including the steps of providing hair separation apparatus having a generally elongate base arranged along a longitudinal axis, and further having a plurality of parallel teeth each attached to the base and oriented transversely to the longitudinal axis; imparting to the hair separation apparatus an oscillatory motion having a component along the longitudinal axis; placing the hair separation apparatus in a group of hairs, each having a length in a given direction; moving the hair separation apparatus through the hairs in a direction generally transverse to the length of the hair, thereby easing passage of the hair separation apparatus through the hairs; and employing apparatus extending parallel to and spaced from the hair separation apparatus for substantially preventing the hair separation apparatus from striking skin to which the hairs are attached when the hair separation apparatus is substantially close to the skin.

In accordance with an additional embodiment of the invention, there is provided a method of treating hair including the steps of providing hair separation apparatus having a generally elongate base and a plurality of parallel teeth each attached to the base and extending transversely therefrom, each tooth having a free end; oscillating the hair separation apparatus; placing the hair separation apparatus in a group of hairs, each having a length in a given direction; moving the hair separation apparatus through the hairs in a direction generally transverse to the length of the hair, thereby easing passage of the hair separation apparatus through the hairs; and employing apparatus, mounted onto the free ends of two or more spaced apart teeth of the plurality of teeth, for substantially preventing the plurality of parallel teeth from striking skin to which the group of hairs is attached when the plurality of parallel teeth is substantially close to the skin.

Preferably, the methods of treating hair are methods delousing lice-infested hair, and the step of imparting an oscillatory motion also includes a step of repeatedly striking the lice and lice eggs so as to cause fatal injury thereto.

BRIEF DESCRIPTION OF THE DRAWINGS

The present invention will be understood and appreciated more fully from the following detailed description, taken in conjunction with the drawings, in which:

FIG. 4A is a schematic representation of hair treatment apparatus as shown in FIG. 1, operative to produce rotational reciprocal motion of the hair separation element about an axis defined thereby;

FIG. 4B is a diagrammatic end view of the apparatus of FIG. 4A, taken in the direction of arrow IVB therein, illustrating the stroke length of the hair separation element of the apparatus of FIG. 4A;

FIG. 5A is a schematic representation of hair treatment apparatus as shown in any of FIGS. 1–3, constructed and operative to produce linear reciprocal motion of the hair separation element along an axis defined thereby;

FIG. 10 shows a pair of drive wheels shown in FIG. 9, as viewed from line X—X therein;

FIG. 11 shows a transmission element shown in FIG. 9, as viewed from line XI—XI therein;

FIG. 12 shows a view of the transmission element of FIG. 11 taken in the direction of arrow XII therein;

FIG. 13 shows a shaped groove defined by a wall portion of the apparatus of FIG. 9, as viewed from line XIII—XIII therein;

FIG. 14 is a view taken along line XIV—XIV in FIG. 9;

FIG. 15 is a view taken along line XV—XV in FIG. 9;

FIG. 16 is a schematic, partial cut-away view of hair treatment apparatus constructed according to a further alternative embodiment of the invention;

FIG. 17 shows the apparatus of FIG. 16, as viewed from line XVII—XVII therein;

FIG. 18 is a partial side view of the apparatus of FIG. 16, as viewed from line XVIII—XVIII therein;

FIG. 23 is a detailed, side-sectional view of the liquid container shown in FIG. 21;

FIG. 24A is a cross-sectional view of the container shown in FIG. 23, taken along line XXIVA—XXIVA therein, wherein passage of the liquid from the container into the conduit system is permitted;

FIG. 24B is a view similar to that of FIG. 24A, but wherein passage of the liquid from the container into the conduit system is prevented;

FIG. 35 is an enlarged schematic illustration of a portion of hair treatment apparatus employing scalp protection apparatus constructed in accordance with a further embodiment of the invention; and FIGS. 36A and 36B are mutually orthogonal, enlarged, cross-sectional views of the end portion of a hair separation element employed in the apparatus of FIG. 35.

DETAILED DESCRIPTION OF THE INVENTION

Figure 1:
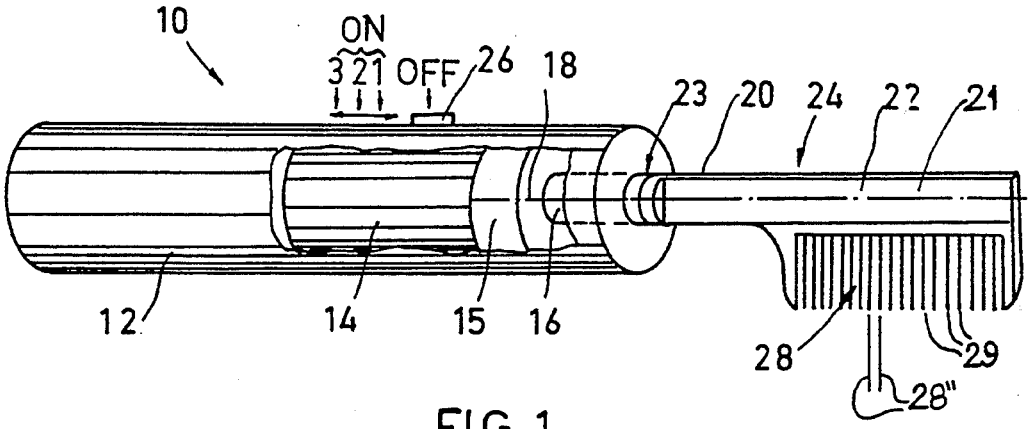
FIG. 1 is a schematic representation of hair treatment apparatus employing a lice comb, constructed and operative in accordance with an embodiment of the invention.
Figure 2:
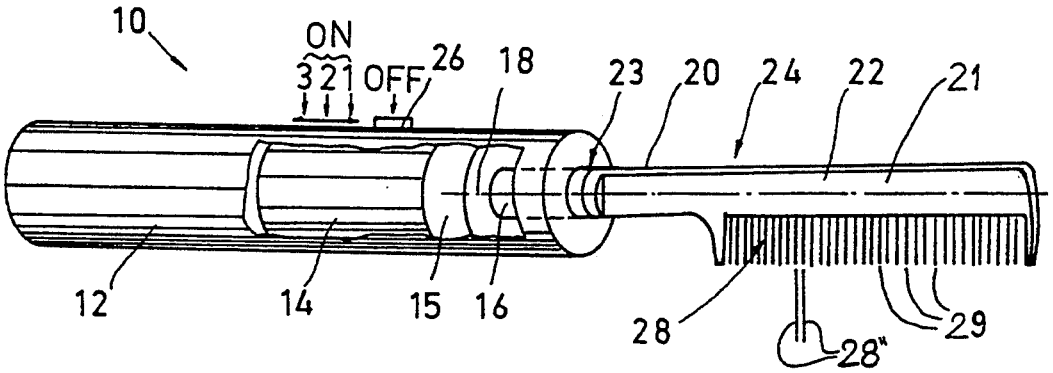
FIG. 2 is a schematic representation of hair treatment apparatus employing a conventional pocket comb, constructed and operative in accordance with an alternative embodiment of the invention.
Figure 3:
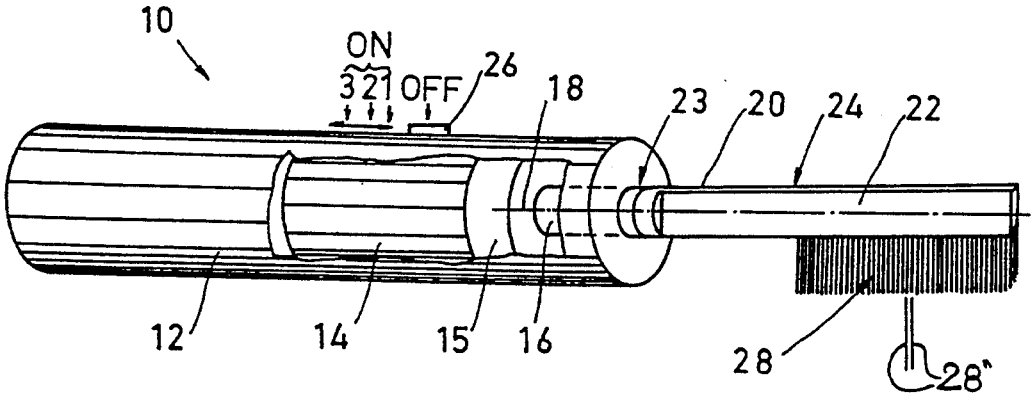
FIG. 3 is a schematic representation of hair treatment apparatus employing a brush element, constructed and operative in accordance with a further embodiment of the invention.

With reference to FIGS. 1–3, there is provided a portable, typically hand-held, hair treatment device, referenced generally 10. Device 10 comprises a hollow, elongate handle 12 which also serves as a housing for a motor 14, such as a 2.4 V dc motor, catalog reference RE-280-2865, made by MABUCHI of 430, Matasuhidai, Matsudo-Shi, Chiba-Ken, 270, Japan. There is also provided a transmission assembly 15 for providing a predetermined motion, as will be described in greater detail below, with reference to FIGS. 4A–7. Handle 12 is typically made from plastic.

The motor 14 may be powered by any suitable power source (not shown), such as batteries, rechargeable batteries or, together with suitable transformer apparatus, an A.C. mains current source. An elongate member 16 associated with transmission 15 lies along an axis 18 and is connected to an elongate arm 20 made typically from a rigid plastic and to which is connected a hair separation element 22, arranged for predetermined reciprocal movement in relation to axis 18, as described in greater detail below in conjunction with FIGS. 4A–7. The connections between element 22 and arm 20, shown at 23, and arm 20 and member 16, shown at 24, may be bayonet connections or any other suitable, preferably detachable connection.

Hair separation element 22 is intended to be passed through the hair in a direction generally transverse to the length of the hair. In the ensuing description, therefore, unless otherwise stated, passage of element 22 through the hair or engagement of hairs thereby is taken to be generally transverse to the length of the hair.

There is also provided a selector 26, typically a slidable switch, mounted onto handle 12 and having typically a single OFF position and one or more ON positions. In the illustrated example, three different ON positions are shown, each of which represents a different motor speed. The selection of different motor speeds may be provided by any suitable means, such as a rheostat (not shown).

Hair separation element 22 comprises a plurality of of preferably parallel elongate elements 28, defining respective longitudinal axes 28″ oriented transversely, preferably perpendicular, to axis 18. Element 22 is, as described, removable from arm 20 and, according to different embodiments of the invention, representing different applications of device 10, element 22 may be a metal or plastic lice comb (FIG. 1), such as disclosed in either of the U.S. Patents to Bachrach and Teale or to Bachrach, a conventional metal or plastic pocket comb (FIG. 2), a brush head (FIG. 3) or any other type of apparatus useful in accordance with an embodiment of the invention.

The junctions of elements 28 with base portion 21 (FIG. 4A) of element 22 are spaced from axis 18. Accordingly, no 'dead point' exists, whereat no force is delivered by elements 28, such as would be the case if the axis were to extend through the elements 28. According to a preferred embodiment, the junctions of elements 28 with base 21 are spaced from axis 18 by a distance equal to at least about one-quarter of the length of elements 28.

In addition to the effective use of the entire length of each element 28, although the force delivered at the free end 29 of each element 28 is greater than that delivered at the portion of element 28 closest to the axis 18, the additional force delivered at the free end of each element 28 does not have to be excessive in order to generate at least a minimum required force at the opposite end. It will be appreciated that the further the beginning of the elements 28 is from axis 18, the less significant becomes the additional distance along each element 28 between the two ends thereof.

It will be appreciated that the above-mentioned choice of motor speeds cause correspondingly different frequencies of oscillation of element 22. The selected speed will depend upon, inter alia, the type of hair, the type and size of element 22 and size and spacing of elongate elements 28. Both the operating speed and the stroke length of free ends 29 of elements 28, when oscillated, are substantially as described hereinbelow in conjunction with FIGS. 4A–7.

With particular reference to FIG. 1, element 22 is, according to an embodiment of the invention, a lice comb. It has been found that the reciprocal motion of the comb when being passed through hair so as to repeatedly strike individual hairs with which it is brought into engagement, causes separation of the individual hairs, whether knotted together, stuck together or otherwise joined. It has been further found that the separation facilitates quick, efficient and comfortable passage of the comb through the hair, generally without uprooting hairs, such as occurs with conventional use of hair combs.

When element 22 which, according to the present embodiment is a lice comb, is passed through the hair close to the scalp, lice and lice eggs attached to individual hairs or to the scalp are physically engaged by elongate elements 28 so as to be loosened and subsequently removed from the hair. Any live lice that are left behind are almost certainly injured by the physical engagement of elements 28 and, as described in the 'Background of the Invention', thus die within a relatively short space of time.

It will be appreciated that use of the present invention for lice removal is particularly advantageous when used on young children, as they generally have less patience to sit for a long time while their hair is combed manually. They also generally have a lower resistance to the pain that is generally caused while freeing the knots in their hair.

Referring now additionally to FIG. 2, a further application of the invention, whether employing a lice comb (FIG. 1) or an ordinary comb (FIG. 2), is that of removing dandruff particles from the scalp and subsequent removal off the particles from the hair.

With reference also to FIG. 3, and according to yet a further embodiment of the invention, when element 22 is a conventional comb (FIG. 2) or a brush element (FIG. 3), device 10 is useful as a tool for hair styling. It has been found that use of device 10 causes separation of hairs from each other so as to facilitate entry of air between hairs, Device 10 may, therefore, be used for styling hair by moving it in a chosen direction and at a chosen angle with respect to the hairs, thus causing the individual hairs to become straightened, for example, or otherwise arranged.

Reference is now made to FIG. 4A in which there is illustrated hair treatment device 10, wherein transmission 15 causes a reciprocal rotation of arm 20 about axis 18, so as to cause a reciprocal rotation of arm 20 through a predetermined angle about axis 18, producing a similar reciprocal rotational motion of element 22, so as to produce a corresponding motion of free ends 29 of elements 28 which, in the present embodiment, are comb teeth.

In accordance with the present embodiment, and with reference particularly to FIG. 4B, free ends 29 of comb teeth 28 define an oscillation stroke of length 'S'. Preferably, as described hereinbelow, the free ends 29 have an amplitude of no more than about 4 mm, equal to a total stroke length of 8 mm, and are operated at a speed of greater than about 4,000 cycles per minute, and preferably greater than about 4,750 cycles per minute.

According to one embodiment of the invention, element 22 is a lice comb as illustrated and described in conjunction with FIG. 1.

Figure 8C:
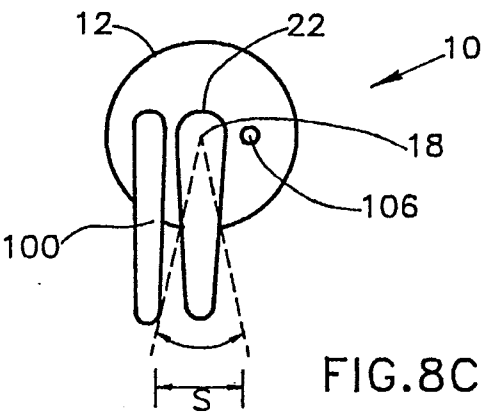
FIGS. 8A, 8B and 8C are respective schematic side, top and end views of the apparatus shown in FIG. 4A and including a scalp guard constructed according to an embodiment of the invention.
Figure 8A:
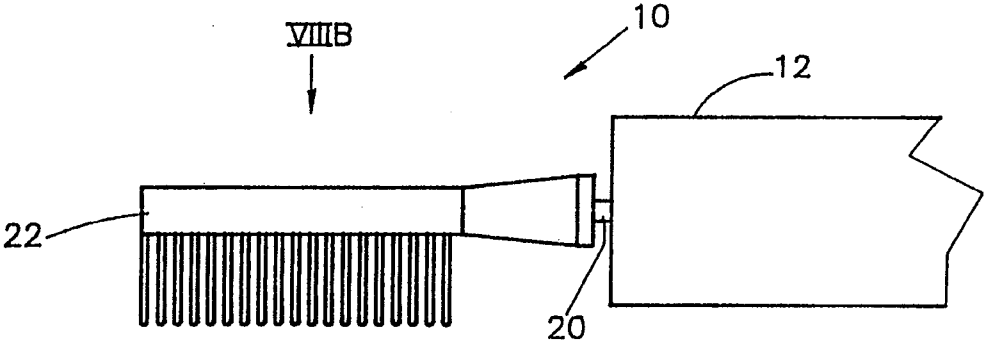
Figure 8B:
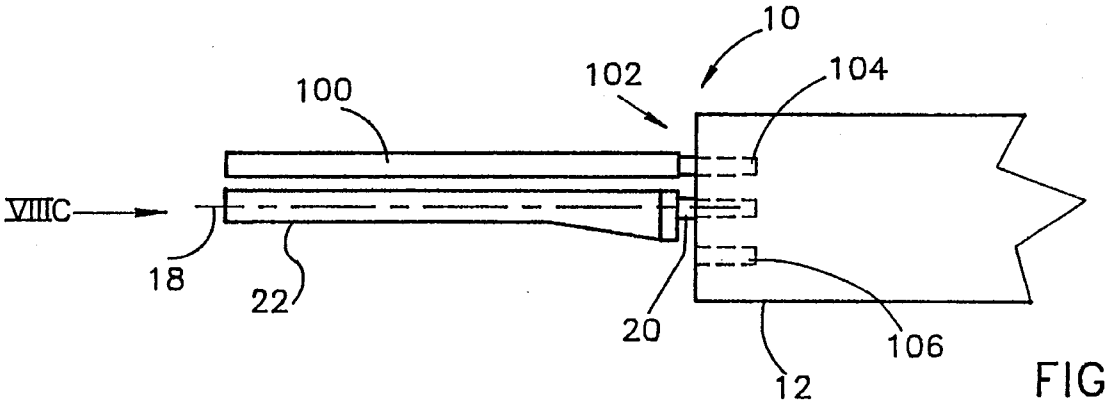

Reference is now made to FIGS. 8A, 8B and 8C, in which there is shown the apparatus 10 as illustrated in FIG. 4A and including a scalp guard element 100 (FIGS. 8A and 8B) constructed according to a further alternative embodiment of the invention.

According to the present embodiment, element 22 may be any of the different elements shown in FIGS. 1–3. The provision of scalp guard element 100 prevents the discomfort that would otherwise be caused, resulting from the repeated striking of the scalp with an unacceptably large force, as described in the background of the invention with regard to the device of Hantman et al.

Element 100 is typically a conventional hair comb and has an end 102 which may be configured for removable insertion into socket 104 defined by handle 12. The connection thereat is, for example, a bayonet connection. The comb-like configuration of element 100, it will be appreciated, is configured for passage through the hair, and provides a barrier between element 22 and the scalp.

According to the shown embodiment, there is also provided an additional socket 106 similar to socket 104, so as to permit mounting of element 100 to either side of element 22, as preferred by a user.

Figure 4D:
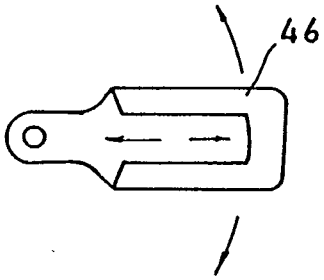
FIG. 4D shows a bottom view of the grooved member of the transmission assembly shown in FIG. 4C.
Figure 4E:
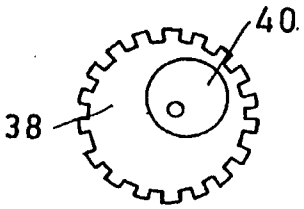
FIG. 4E shows a top view of the second toothed wheel of the transmission assembly shown in FIG. 4C.
Figure 4C:
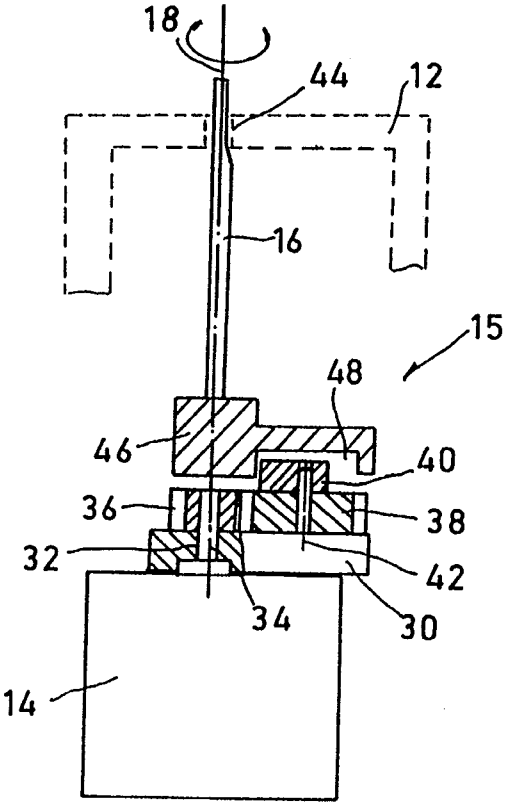
FIG. 4C is a schematic, partially cut away side view of the transmission of the apparatus shown in FIG. 4A.

Referring now additionally to FIGS. 4C–4E, transmission assembly 15 comprises a flat base plate 30, typically made of plastic, mounted onto motor 14 and defining an aperture 32 through which the rotor, referenced 34, of motor 14, extends. Axially mounted onto rotor 34 is a first toothed wheel 36. A second toothed wheel 38, defining an eccentric protrusion 40, is mounted onto base plate 30 for rotation about an axis 42.

Elongate member 16, which is supported in an aperture 44 of housing 12 is mounted along axis 18 and extends from a member 46 defining a groove 48, arranged for cooperation with protrusion 40 of second toothed wheel 38. As motor 14 is activated so as to rotate rotor 34 and thereby rotate first toothed wheel 36, second toothed wheel 38 is engaged thereby so as to rotate protrusion 40 thereof eccentrically about axis 42.

It will be appreciated that the eccentric rotation of protrusion 40 results in a back and forth movement within groove 48, as illustrated in FIG. 4D, causing a partial rotation of member 16 in alternating directions.

During tests carried out by the inventor, with the aim of determining a preferred mode of operating oscillatory hair treatment apparatus constructed substantially as set forth herein, results were obtained as summarized in tables I and II below. The tests were performed on a group of twenty subjects between the ages of 8 and 15, and of whom 12 were male and 8 female.

The hair treatment apparatus was operated at two different amplitudes, namely, of 2 mm and 4 mm, providing respective total stroke lengths of 4 mm and 8 mm. The apparatus was operated at four different oscillation frequencies, namely, 1,000, 2,000, 4,000 and 8,000 cycles per minute.

The reaction of each subject under each set of operating conditions was recorded in accordance with a comfort scale of 1 to 10, wherein a score of 1 indicates no discomfort whatsoever, a scope of 10 indicates a large amount of discomfort, and a scope of 5.5 indicates a tolerable amount of discomfort.

The reactions of the twenty subjects to each set of operating conditions were combined so as to obtain an average scope for each set of conditions, thereby providing an indication of acceptable and preferred operating modes of the apparatus.

For the purpose of determining acceptable and preferred operating modes of the apparatus, an average scope of 5.5 was taken to be a level whereat no significant discomfort was experienced, and would thus be acceptable, while a preferred level would be that closest to 1.

In the set of tests whose results are listed in table I, wherein the apparatus was operated at an amplitude of 4 mm, an oscillating frequency of 4,000 cycles per minute provided an average score of 5.65, marginally outside the acceptable level, while an oscillating frequency of 8,000 cycles per minute provided an average score of 4.85, better than the acceptable level.

Accordingly, allowing for a reasonable margin of error, the oscillating frequency of the hair treatment apparatus should be no less than approximately 4,000 cycles per minute. Preferably, however, at an amplitude of 4 mm (total stroke length of 8 mm) the apparatus should be operated at an oscillating frequency of 4,750 cycles per minute, which, by interpolation, produces an average score of 5.5.

In the set of tests whose results are listed in table II, wherein the apparatus was operated at an amplitude of 2 mm, an oscillating frequency of 4,000 cycles per minute provided an average score of 4.55, better than the acceptable level, while an oscillating frequency of 8,000 cycles per minute provided an average score of 2.95, much better than the acceptable level and thus indicating a good oscillation frequency and amplitude at which to operate the apparatus.

According to the results of the above-described tests, the oscillation frequency of 4,000 cycles per minute caused a tolerable amount of discomfort to the tested subjects, while a reduction of the amplitude of oscillation from 4 mm to 2 mm, produced a corresponding reduction in the discomfort experienced.

It will be appreciated by persons skilled in the art that, using the above-described tests as a guide for operating conditions, a reduction in the amplitude of oscillation may be accompanied by a corresponding reduction in the oscillation frequency. It is thus envisaged that, the oscillation frequency could be reduced to, for example, 3,000 cycles per minute, provided that the oscillation amplitude is reduced correspondingly.

TABLE I

| | Amplitude 4 mm | | | |
|---|---|---|---|---|
| | Frequency (cycles/min.) | | | |
| | 1,000 | 2,000 | 4,000 | 8,000 |
| | Comfort Reading | | | |
| Subject No. | (CR) | CR | CR | CR |
| 1 | 8 | 8 | 6 | 6 |
| 2 | 10 | 10 | 8 | 6 |
| 3 | 6 | 5 | 3 | 2 |
| 4 | 7 | 7 | 5 | 4 |
| 5 | 8 | 9 | 6 | 6 |
| 6 | 9 | 9 | 5 | 3 |
| 7 | 7 | 7 | 4 | 2 |
| 8 | 7 | 7 | 6 | 4 |
| 9 | 8 | 8 | 8 | 8 |
| 10 | 9 | 9 | 9 | 9 |
| 11 | 6 | 6 | 3 | 3 |
| 12 | 8 | 8 | 6 | 4 |
| 13 | 5 | 6 | 4 | 3 |
| 14 | 7 | 7 | 7 | 7 |
| 15 | 7 | 7 | 6 | 4 |
| 16 | 5 | 5 | 5 | 5 |
| 17 | 9 | 9 | 5 | 3 |
| 18 | 7 | 7 | 5 | 4 |
| 19 | 8 | 8 | 8 | 8 |
| 20 | 7 | 7 | 4 | 2 |
| AVERAGE COMFORT READING | 7.4 | 7.45 | 5.65 | 4.65 |

TABLE II

| | Amplitude 2 mm | | | |
|---|---|---|---|---|
| | Frequency (cycles/min.) | | | |
| | 1,000 | 2,000 | 4,000 | 8,000 |
| | Comfort Reading | | | |
| Subject No. | (CR) | CR | CR | CR |
| 1 | 7 | 7 | 5 | 4 |
| 2 | 8 | 8 | 5 | 3 |
| 3 | 5 | 5 | 3 | 2 |
| 4 | 7 | 7 | 4 | 3 |
| 5 | 8 | 8 | 5 | 4 |
| 6 | 7 | 7 | 5 | 3 |
| 7 | 7 | 7 | 4 | 3 |
| 8 | 6 | 7 | 4 | 2 |
| 9 | 8 | 8 | 5 | 5 |
| 10 | 9 | 9 | 7 | 5 |
| 11 | 5 | 5 | 2 | 1 |
| 12 | 8 | 8 | 5 | 3 |
| 13 | 5 | 5 | 3 | 1 |
| 14 | 7 | 7 | 5 | 4 |
| 15 | 7 | 6 | 3 | 3 |
| 16 | 4 | 4 | 4 | 1 |
| 17 | 9 | 9 | 5 | 1 |
| 18 | 7 | 7 | 4 | 2 |
| 19 | 8 | 8 | 8 | 7 |
| 20 | 7 | 5 | 5 | 2 |
| AVERAGE COMFORT READING | 6.95 | 6.85 | 4.55 | 2.95 |

Referring generally to FIGS. 5A–7, motor 14 and transmission assembly 15 are operated, according to the embodiments described below, to drive element 22 so as to have at least a component of parallel or linear motion. When the motion of element 22 is linear only, the force delivered at every point on the element is substantially uniform and enables the application of a minimum force such as determined to be necessary in order to achieve a required range of motion of the element and so as to provide no significant discomfort to the scalp as occurs with use of the known device to Hantman et al referred to in the background of the invention.

Particular reference is now made to FIG. 5A in which there is illustrated hair treatment device 10, wherein transmission 15 causes oscillation of comb teeth 28 between first and second orientations at respective first and second extreme positions along a stroke path, wherein the first and second orientations are mutually parallel. In the present embodiment, this motion is provided by oscillating arm 20 along axis 18, thereby producing a similar reciprocal rotation of element 22.

The overall stroke length (which equals twice the amplitude), denoted by the letter 'S', and the frequency, are substantially in the range described hereinabove, being no more than about 8 mm and at least about 4,000 cycles per minute, respectively. Preferably, the oscillating frequency is at least approximately 4,750 cycles per minute.

Figure 5B:
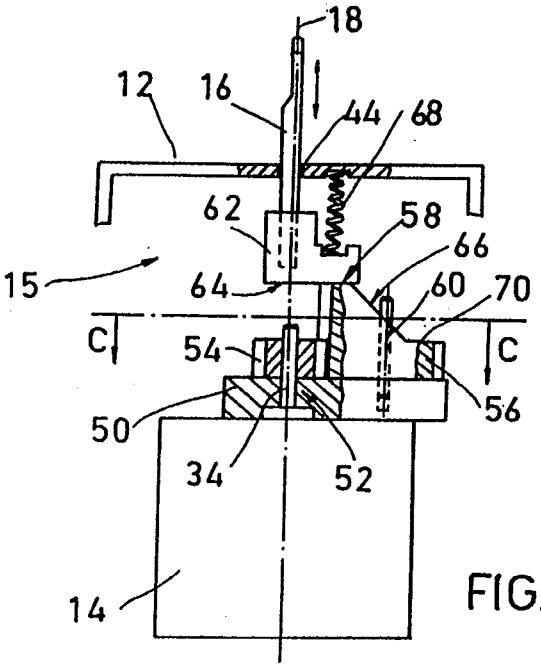
FIG. 5B is a schematic, partially cut away side view of the transmission of the apparatus shown in FIG. 5A.
Figure 5C:
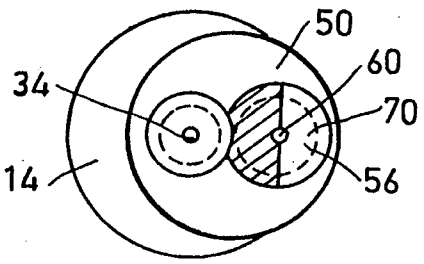
FIG. 5C is a partially cut-away view of the transmission of the apparatus of FIG. 5A, taken along line C—C in FIG. 5B.

Referring now additionally to FIGS. 5B and 5C, transmission assembly 15, according to the illustrated embodiment, comprises a flat base plate 50, typically made of plastic, mounted onto motor 14 and defining an aperture 52 through which rotor 34 extends. Axially mounted onto rotor 34 is a first toothed wheel 54. A second toothed wheel 56, defining a raised surface 58, is mounted onto base plate 50 for rotation about an axis.

Elongate member 16, which is supported in aperture 44 of housing 12 is mounted alone axis 18 and extends from a member 62. Member 62 defines a bottom surface 64 which is retained in contact with a portion of an upper surface 66 of second toothed wheel 56 by a compression spring 68, extending between housing 12 and member 62.

Rotation of second toothed wheel 56 is effective to alternately bring into contact with bottom surface 64 of member 62, raised surface 58 of wheel 56 and a non-raised surface 70 thereof. As spring 68 is continually urging member 62 in the direction of motor 14, a reciprocal linear motion of arm 16 results from rotation of second toothed wheel 56 and, therefore, a similar reciprocal motion of hair separation element 22.

In both the embodiment of FIGS. 4A–4E and the embodiment of FIGS. 5A–5C, the second toothed wheel has a diameter that is larger, typically by a factor of two, than the diameter of the first toothed wheel. This results in a reduced speed of rotation of the second toothed wheel compared to the speed of rotation of the first toothed wheel. Provision of toothed wheels of differing sizes thus permits, operation of the device of the present invention within a predetermined range of speeds, without particular regard to the speed of the motor.

Figure 6B:
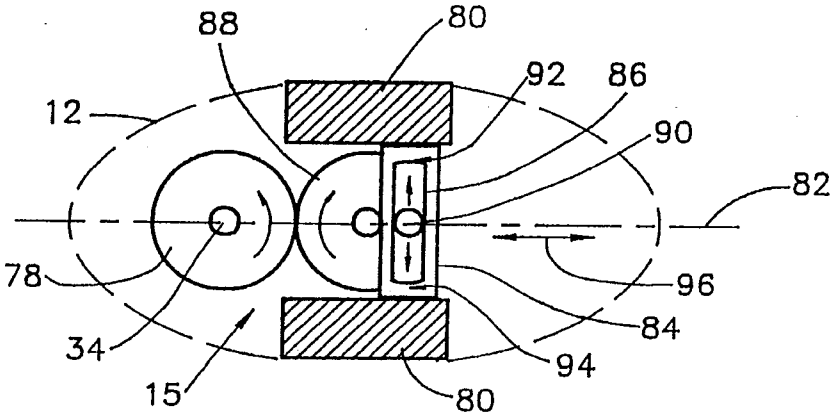
FIG. 6B is a cut away view of the of the apparatus of FIG. 6B, taken along line VIB—VIB therein.
Figure 6A:
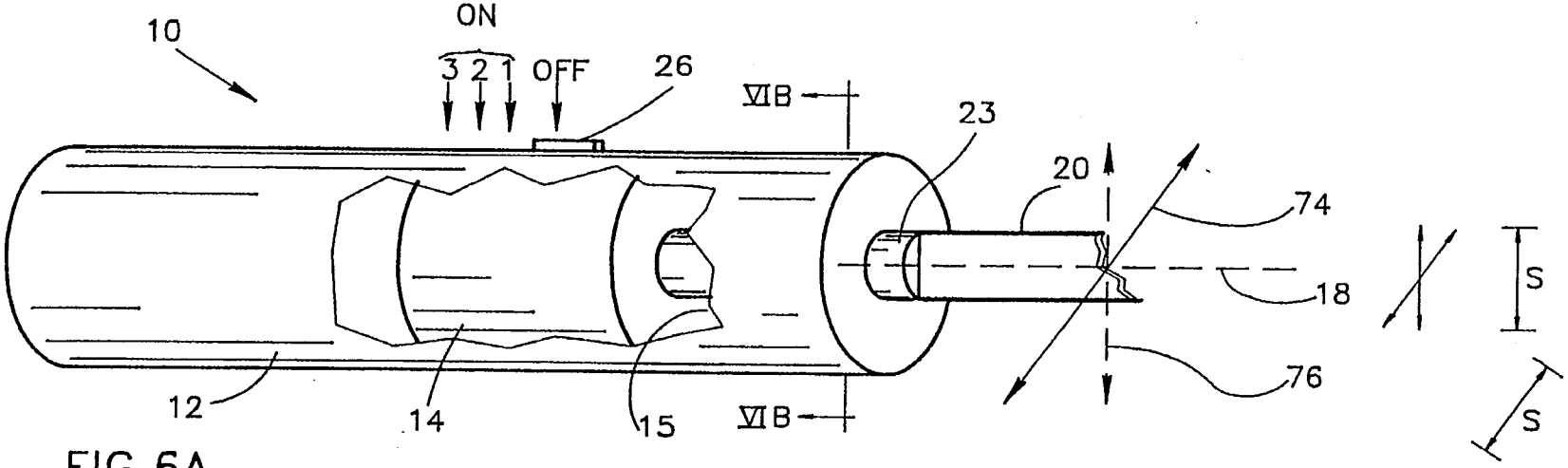
FIG. 6A is a schematic representation of hair treatment apparatus as shown in any of FIGS. 1–3, operative to produce linear reciprocal motion of the hair separation element in a direction transverse to an axis defined thereby.

Reference is now made to FIG. 6A in which there is illustrated hair treatment apparatus as shown in any of FIGS. 1–3, wherein transmission 15 causes oscillation of comb teeth 28 between first and second orientations at respective first and second extreme positions along a stroke path, wherein the first and second orientations are mutually parallel. In the present embodiment, this motion is provided by oscillating arm 20 in a direction transverse to axis 18.

As will be appreciated from the ensuing description of transmission 15, element 22 may be mounted onto arm 20 as to move in any predetermined direction transverse to axis 18. For example, alternative mutually orthogonal directions are indicated at respective arrows 74 and 76. The stroke length, denoted by the letter 'S', and the frequency, are substantially in the range described hereinabove, being no more than about 8 mm and at least about 4,000 cycles per minute, respectively. Preferably, the oscillating frequency is at least approximately 4,750 cycles per minute.

Referring now to FIG. 6B, the transmission 15 of the device of FIG. 6A comprises a first toothed wheel 78 mounted onto rotor 34 of motor 14 (FIG. 6A). Fixed blocks 80, supported typically on an inner surface of housing 12, define parallel surfaces 81 spaced about an axis 82, lying transversely to axis 18 (FIG. 6A). Transverse axis 82 is typically parallel to either of directions shown at 74 and 76 (FIG. 6A).

A reciprocating member 84, which is attached to arm 16 (not shown), defines a groove 86, shown as hidden detail by broken lines. A second toothed wheel 88 is arranged to be rotated by first toothed wheel 78 and defines a fixed protrusion 90. Groove 86 is arranged to engage protrusion 90 such that as second toothed wheel 88 is rotated by the first toothed wheel, and consequently protrusion 90 is also rotated, protrusion 90 moves in reciprocating fashion between ends 92 and 94 of groove 86 and member 84 is also moved, so as to reciprocate from side to side as indicated by arrow 96.

This reciprocating movement is transmitted to arm 20 and, therefore, element 22 (not shown) and, depending on the orientation of element 22 with respect to housing 12, element 22 will be moved in a direction transverse to axis 18, from side to side, up and down, or in any other pair of opposing directions, according to the orientation of element 22 relative to housing 12.

Figure 7:
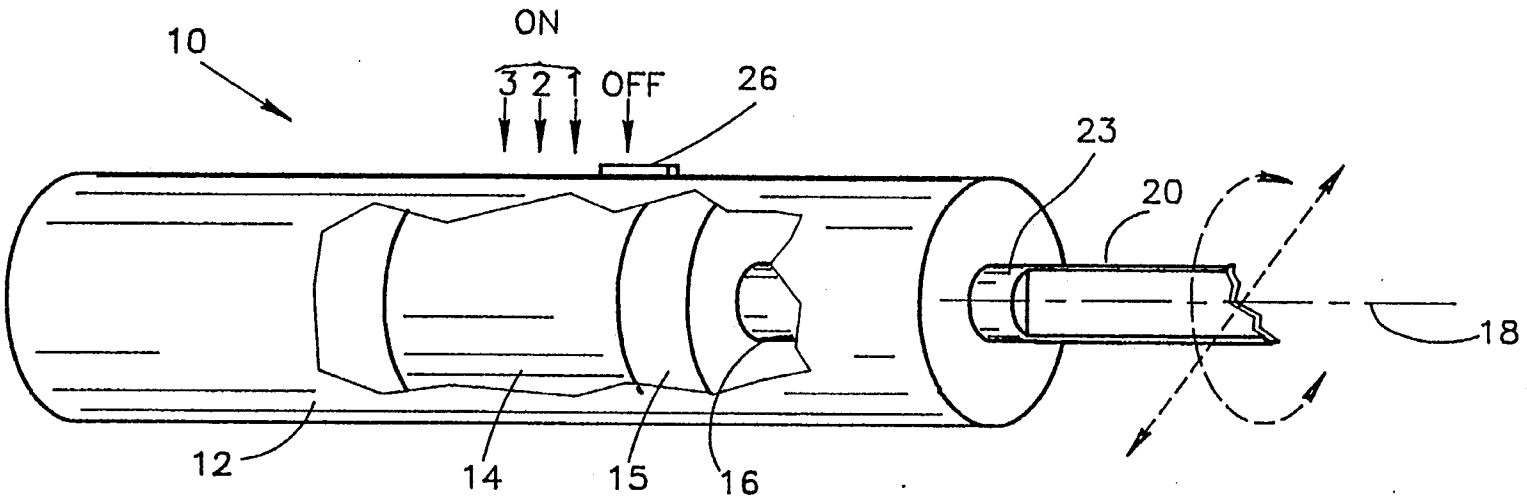
FIG. 7 is a schematic representation of hair treatment apparatus as shown in any of FIGS. 1–3, operative to produce reciprocal combination motion of the hair separation element in a direction having components of motion transverse to and about an axis defined thereby.

Reference is now made briefly to FIG. 7, in which the apparatus 10, as illustrated in any of FIGS. 1–3, is shown as providing a reciprocal combination motion of the hair separation element 22 in a direction having components of motion transverse to and about axis 18. The transmission 15 useful for producing such a combined motion may be any such conventional transmission and typically as found in an electric toothbrush marketed under the trade name "Dental D3" and manufactured by Braun Ltd., West Germany. The linear stroke length provided at the ends of teeth 22 (FIGS. 1–3) according to the present embodiment, is preferably similar to the stroke length provided by any of the above-described embodiments. Accordingly, the linear stroke length is preferably no more than about 8 mm, and the frequency of oscillation is preferably at least about 4,000 cycles per minute. Preferably, the oscillating frequency is at least approximately 4,750 cycles per minute.

It will be appreciated by persons skilled in the art that the device of the present invention is useful not only for human hair, but may also be used for delousing and otherwise cleaning animals.

Reference is now made to FIGS. 9 to 15, in which is illustrated a hand-held, portable hair treatment device, referenced generally 120, constructed according to an alternative embodiment of the invention.

Device 120 includes a hollow handle 122; a motor 124, which may be similar to motor 14 as described above conjunction with FIGS. 1–7; and a transmission system 126. Motor 124 and system 126 are preferably housed within handle 122.

Motor 124 is operative to drive a first toothed wheel 126 (FIGS. 9 and 10) mounted thereon, which, in turn, is operative to drive a second toothed wheel 128, mounted for rotation about a first axis 130. Second toothed wheel 128 defines an eccentrically mounted protrusion 132, which extends through a generally semicircular opening 134 (FIG. 11) in a transmission element 136.

A pair of parallel elongate members, namely, a fixed, scalp guard member 137 and a movable hair separation member 138 are mounted in association with handle 122. Hair separation member 138 may be any suitable type of hair comb or lice comb, for example. An intermediate elongate member 139 is movably mounted onto scalp guard member and, as described below, is operative to cooperate therewith so as to momentarily hold a group of hairs, while hair separation member 138 is simultaneously moved away from members 137 and 139 so as to free knots and tangles in the hair. The consequent pulling force that is applied to the hair by hair separation member 138 is transferred to the pair of members 137 and 139—and not to the scalp—by virtue of the momentary holding of the hairs by the pair of members.

Hair separation member 138, which is typically a lice comb or a conventional-type hair comb, defines an end portion 141 by which it is mounted onto an elongate element 140 extending through an opening 142 in handle 122 along a second axis 144. Transmission element 136 is fixedly attached to elongate element 140 substantially at right angles. As second toothed wheel 128 is rotated, causing eccentric rotation of protrusion 132 relative to first axis 130, the protrusion 132 is operative to move transmission element 136. By virtue of the semicircular shape of the opening 134 of the transmission element 136, the resulting motion of element 136 is a reciprocating rotational movement about second axis 144. As transmission element 136 and elongate element 140 are rigidly attached to each other, element 140 and, consequently, hair separation member 138 are also moved in reciprocating rotational fashion about second axis 144.

Fixed scalp guard member 137 is mounted onto handle 122 along a third axis 146 and intermediate elongate member 139 is mounted onto scalp guard member 137 so as to be movable along a fourth axis 148, parallel to third axis 146. Both of members 137 and 139 define parallel teeth 141 at right angles to respective axes 146 and 148. While the teeth are arranged in a generally comb-like fashion, they are relatively widely spaced apart in comparison with the spacing of teeth 143 of hair separation member 138. In the illustrated 'at rest' position, teeth 141 of members 137 and 139 are in registration with each other, so as to permit relatively easy introduction into a group of hairs.

As illustrated, scalp guard member 137 has a number of fixed, generally transversely arranged elements 150, each defining an opening 152 (FIG. 15) through which intermediate member 139 extends. Thus, while member 139 is permitted to move along fourth axis 148, it is secured against movement in any other direction.

With particular reference to FIGS. 11–13, transmission element 136 also defines an end protrusion 154 which is arranged for movement within a groove 156 (FIG. 13) defined by a wall portion 158 of handle 122. As element 136 moves in reciprocal fashion as described, end protrusion 154 is moved similarly within groove 156. Groove 156 has a generally curved shape, however, a lower end portion thereof being illustrated at 159 and an upper end portion being shown at 160. Therefore, as element 136 is moved from side to side, so as to have first components of motion as represented by double-headed arrow 162 (FIG. 13), it is forced along a path similar to that defined by groove 156, so as to have further second components of motion as shown by double-headed arrow 164, orthogonal to the first components of motion and parallel to second axis 144.

Figure 9:
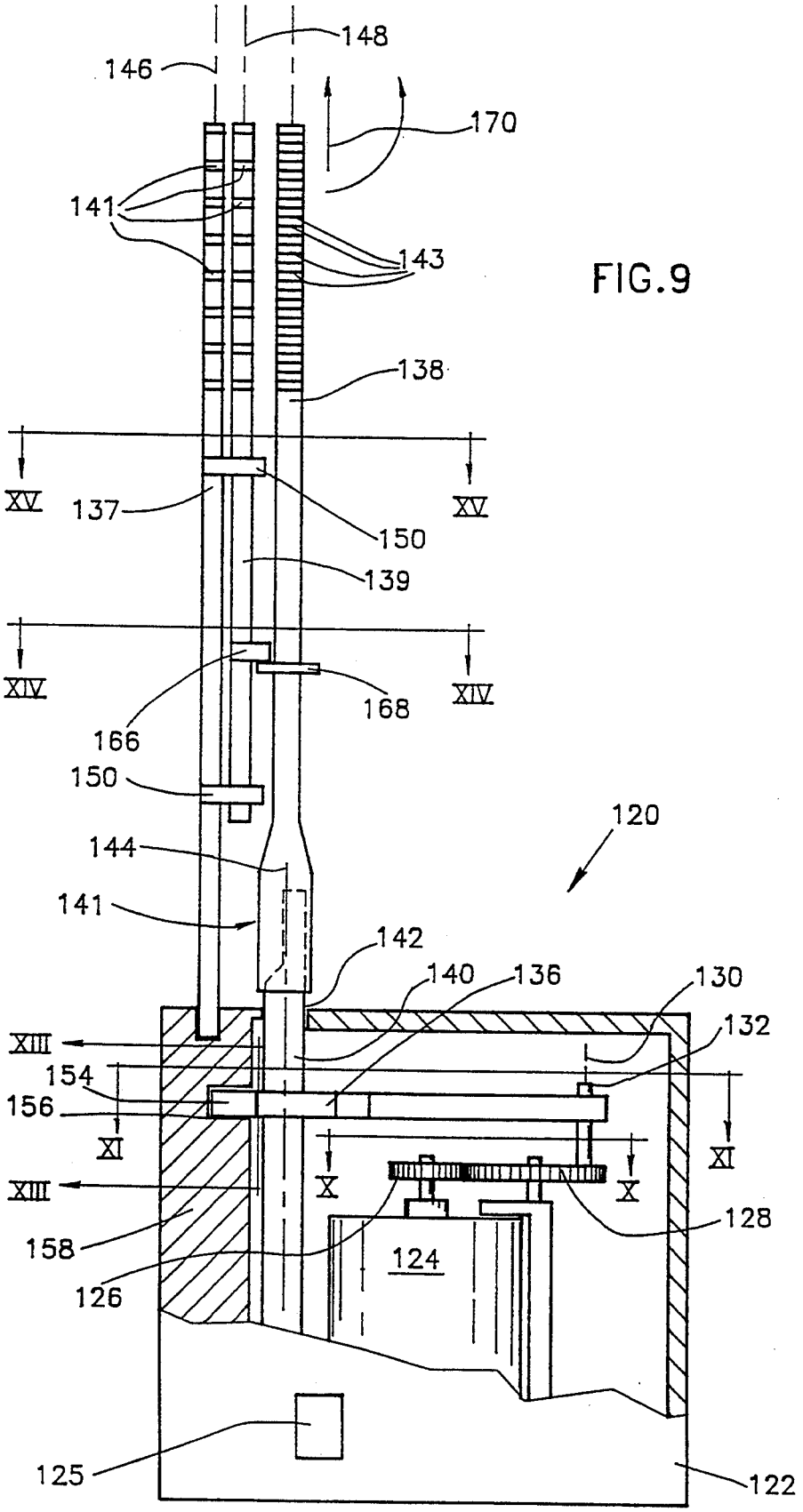
FIG. 9 is a schematic, partially cut-away view of hair treatment apparatus constructed according to an alternative embodiment of the invention.

It will be appreciated, therefore, that hair separation member 138 moves not only about second axis 144, as described, but also along the axis. As illustrated in FIGS. 9 and 14, fixed onto hair separation member 138 and intermediate member 139 are respective first and second transversely arranged, overlapping elements 166 and 168. As hair separation member 138 is displaced axially away from handle 122, as shown by arrow 170, first element 166 is engaged by with second protruding element 168, so as to be axially displaced thereby in a similar direction.

In operation, the three elongate members, 137, 138 and 139, are introduced into a group of hairs, with scalp guard member 137 being arranged closest to the scalp. As the motor 124 is activated, as by a switch 129, hair separation member 138 is rotated in reciprocating fashion about second axis 144, and is also simultaneously moved therealong, also in reciprocating fashion, away from handle 122, as shown by arrow 170, and back towards handle 122.

As hair separation member 138 is moved away from the handle, intermediate member 139 is displaced in a similar direction, by means of the overlapping elements 166 and 168. Scalp guard member 137 is, however, fixed relative to the handle 122, so that as member 139 moves, its teeth move out of alignment with those of scalp guard member 137 such that any intervening hairs are grasped therebetween. At the same time, hair separation element 138 is rotated about second axis 144, and, as it is moved rotationally away from member 139 and encounters knots and tangles in the hair, the force by which member 138 seeks to free the knots and tangles is transmitted not the scalp, but to the members 137 and 139, which, at that instant, are securely holding the hairs. As the hair separation member 138 moves rotationally back towards intermediate member 139, it also returns axially towards handle 122, and intermediate member 139 is thus free to be moved back into alignment with scalp guard member 137.

It will thus be appreciated that, while apparatus 120 provides a way of freeing knots and tangles from hair in a painless manner, any lice or lice eggs that are encountered by the hair separation member 138 will be fatally injured, as described hereinabove.

In an alternative embodiment of the invention, transmission system may be replaced by a simpler system providing just axial movement to the separation member 138, with no relative movement thereof occurring about axis 140.

Typically, the motion imparted to hair separation member 138 is such that teeth 143 thereof oscillate through an overall stroke length of no more than approximately 8 mm, and at a speed that is typically greater than 4,000 cycles per minute, and preferably 4,750 cycles per minute, as described hereinabove. These typical operating conditions ensure that, in the event that device 120 is placed on the scalp incorrectly, with separation member 143 being placed adjacent to the scalp rather than scalp guard member 137, no significant discomfort will be experienced by a user.

Reference is now made to FIG. 16, which is a schematic partial view of a hand-held portable hair treatment device 172, having a handle 174 housing a motor 176 (similar to motor 124 in FIG. 9) which drives a hair separation member 178, such as a hair comb of lice comb, for example, and an intermediate member relative to a fixed, scalp guard member 182, via a transmission assembly 184. Members 178, 180 and 182 have constructions similar to the respective hair separation member 138, intermediate member 139 and scalp guard member 137 of the embodiment of FIG. 9 and are, therefore, not described herein detail.

Referring additionally to FIGS. 17 and 18, transmission assembly includes first and second toothed wheels respectively referenced 185 and 186. First toothed wheel 185 is mounted onto a rotor 187 of the motor and has a first eccentrically mounted protrusion 188 operative to engage a shaped opening 189 of a first transmission element 190 connected to intermediate member 180. Second toothed wheel 186 is arranged for rotation by first toothed wheel 185 and has a second eccentrically mounted protrusion 191 operative to engage a shaped opening 192 of a second transmission element 193 connected to hair separation member 178.

Members 178 and 180 are arranged so as to be movable along parallel axes, respectively referenced 194 and 195, while scalp guard member is mounted statically onto handle 174. In operation, motor 176 is operative to cause rotation of the first and second toothed wheels and, therefore, of the first and second eccentric protrusions. Rotation of each protrusion in the opening of each respective transmission element causes oscillation of both the hair separation member 178 and the intermediate member 180 along their respective axes.

As with the hair treatment device 120 of FIG. 9, the reciprocal motion of the intermediate member 180 relative to scalp guard member 182 causes intervening hairs to be momentarily gripped and released. The gripping occurs simultaneously with the axial oscillation of hair separation member 178 within the hair, so that member 178 is effective to free knots and tangles from the hair, while any force applied thereto is not transmitted to the scalp, but is instead absorbed by members 180 and 182.

Reference is now made to FIGS. 19A to 20B, which show a hand-held, hair treatment device, referenced generally 200, constructed and operative in accordance with a preferred embodiment of the invention.

Device 200 includes a preferably hollow handle 202, in which is housed a motor 204, typically similar to motor 14 as illustrated and described above in conjunction with FIGS. 1–7 Handle 202 is attached to a housing having a base 206 and a cover 208, configured to fit over the base. Base 206 defines a number of openings 210 which are separated by transverse, relatively wide, teeth-like protrusions 212.

Figure 19A:
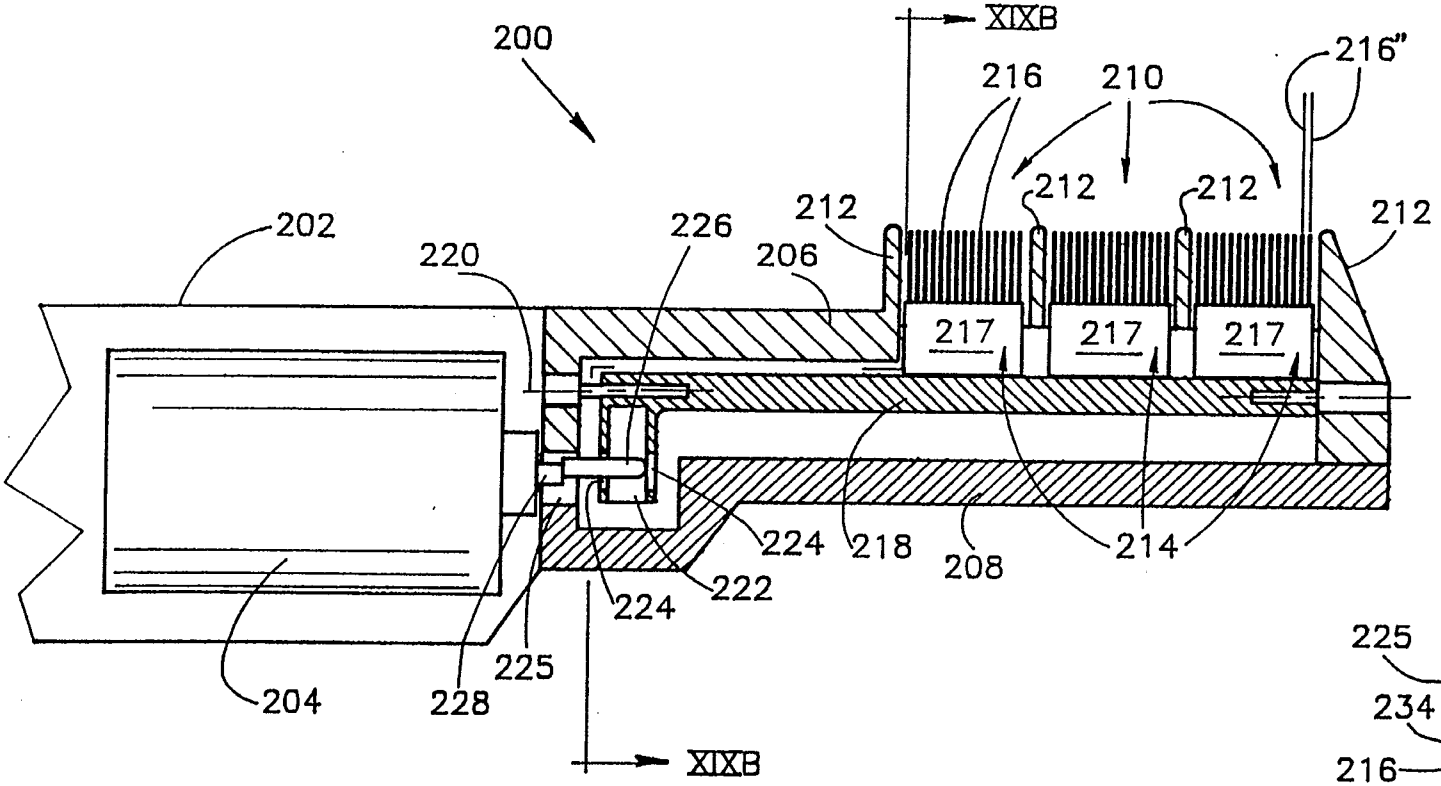
FIG. 19A is a schematic, partially cut-away view of hair treatment apparatus constructed according to an additional embodiment of the invention.
Figure 19B:
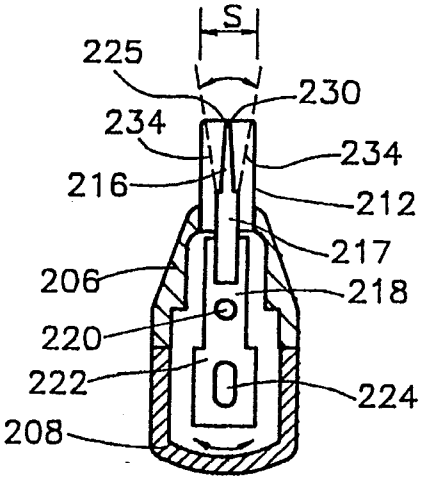
FIG. 19B is a cross-sectional view of the apparatus of FIG. 19A, taken along line XIXB—XIXB therein.
Figure 20B:
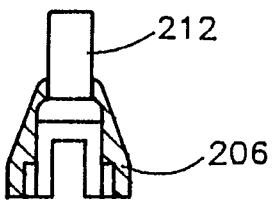
FIG. 20B is a cross-sectional view of the apparatus of FIG. 20A, taken along line XXB—XXB therein.
Figure 20A:
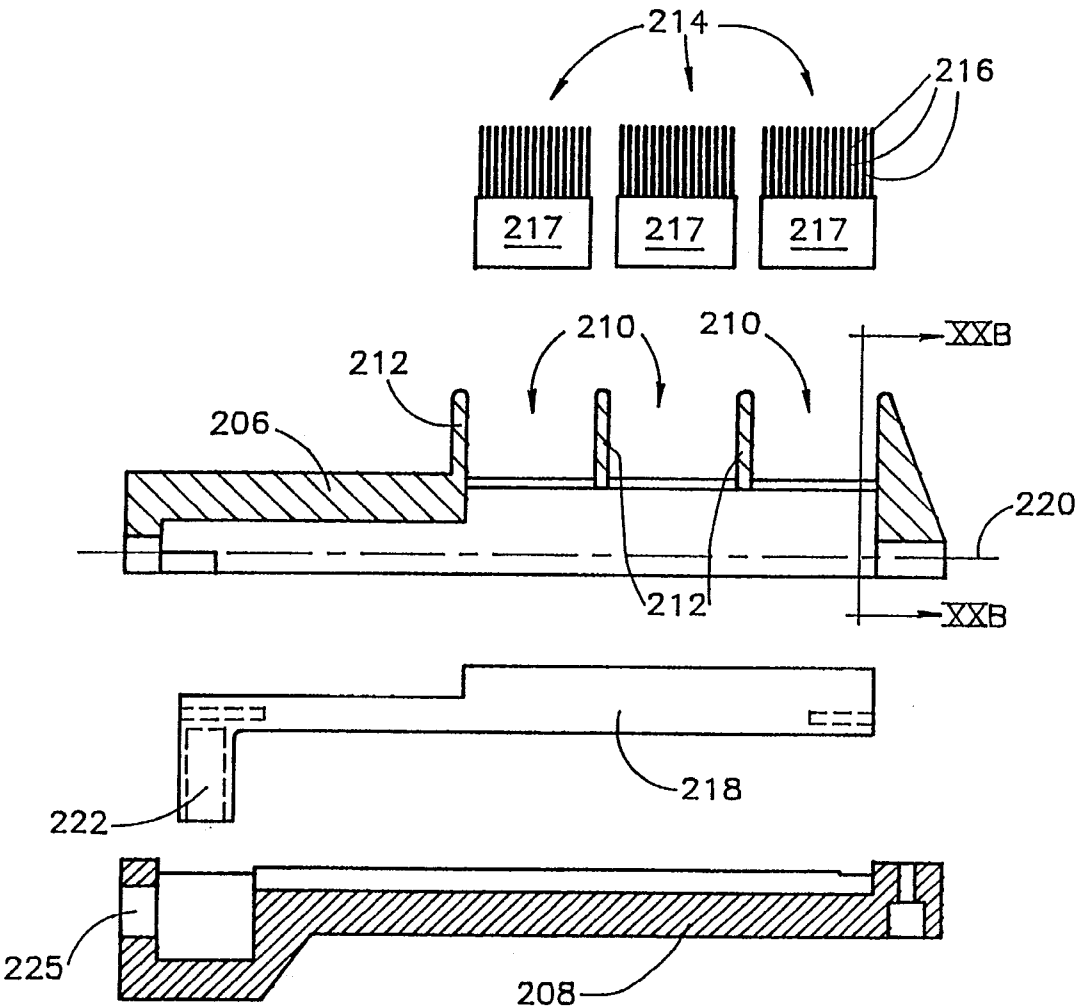
FIG. 20A is an exploded, partially cut-away view of the apparatus of FIG. 19A.

A plurality of comb elements 214, each having a predetermined number of teeth 216, extending along respective longitudinal axes 216'' and protruding outwardly from base portions 217, are arranged for insertion into, and are thus supported by, an elongate comb support 218. Comb support 218 is mounted in base 206 for rotation about an axis 220. Protrusions 212 and teeth 216 are arranged perpendicular to rotation axis 220. As illustrated, each comb element 214 is arranged in one of openings 210 and, as illustrated in FIG. 19B, teeth 216 are much narrower than protrusions 212. As will be appreciated from the ensuing description, protrusions 212 provide a means of protecting the scalp from the reciprocating motion of teeth 216 (described below), while not interfering with it.

Comb support 218 defines, at its end closest to the handle 202, a downwardly extending, transverse portion 222, which defines a pair of similar openings 224. Openings 224 are in mutual alignment in a direction parallel to the rotation axis 220, and they are generally elongate in shape, their long dimension being substantially perpendicular to the rotation axis 220.

Openings 224 are arranged for engagement by an eccentric portion 226 defined by a rotation element 228 mounted onto the rotor (not shown) of the motor 204 and extending through an opening 225 provided in a rear portion of cover 208. As will be appreciated by persons skilled in the art, rotation of rotation element 228 causes eccentric rotation of the eccentric portion 226. The motion of portion 226 may thus be divided into linear components of motion along first and second mutually perpendicular axes (not shown), the first axis being parallel to the direction of teeth 216 and the second axis being perpendicular to the direction of teeth 216 and to the rotation axis 220.

As eccentric portion 226 is rotated, its movement is not restricted in the direction parallel to teeth 216, as it is free to reciprocate between the ends of openings 224. In the direction perpendicular both to the direction of teeth 216 and to the rotation axis 220, however, eccentric portion 226 is operative to reciprocally move the transverse portion 222 and, therefore, comb support 218 and comb elements 214, in a side to side motion about rotation axis 220, as indicated diagrammatically in FIG. 19B.

It is a particular feature of the present embodiment that, as illustrated in FIG. 19B, protrusions 212 are configured to be longer and wider than teeth 216, and the described oscillation of teeth 216 about axis 220 is confined to a sector defined by the projection of the free end 230 of each protrusion 212. As with above-described embodiments of the invention, the overall stroke length 'S' of free end 225 of each individual tooth 216 may be limited to no more than about 8 mm, and may be oscillated at a speed of greater than 4,000 cycles per minute. These values of stroke length and oscillation speed are, however, typical values only, and, in the present embodiment, will not significantly affect the comfort of a user, due to the provision of a two-sided scalp guard constituted by protrusions 212.

Accordingly, when the device 200 of the present invention is used, protrusions 212 are moved along the scalp in combing fashion, but while teeth 216 are nor permitted to strike the scalp, they are brought sufficiently close to the scalp so as to fatally injure lice and lice eggs present in the hair and to loosen and remove dandruff and other unwanted particulate matter from the scalp, as described hereinabove. The motion of teeth 216 is, as with previous embodiments, also effective to free knots and tangles in the hair.

As with previously described embodiment of the invention, comb elements may have either a lice comb or a more conventional, pocket comb type of construction. Although the spacing between protrusions 212 may be any preferred spacing, it should not be so great that the comb teeth 216 could strike the scalp. This could happen due to the curvature of the head. The spacing between protrusions 212 is thus typically between 5 mm and 20 mm, although preferably between 10 mm and 15 mm.

In addition, the number of teeth provided on each comb element 214 may also be varied, according to the type of comb. Thus, when the construction of comb elements is that of a lice comb, depending on the spacing selected, each comb element preferably has between 15 and 40 teeth. When the construction of the comb elements is that of a more conventional pocket comb, typically 3 to 10 teeth are provided on each comb element. It will also be appreciated that while with a lice comb construction a generally shorter overall length will be sought, such that typically three comb elements are used, with a more conventional construction, a generally longer overall length will be sought, and between three and fourteen comb elements, for example, may be employed.

A further feature of the present embodiment is that the entire portion of each tooth 216 that engages the hair is spaced from the rotation axis 220, so that no 'dead point' exists on the tooth, as described above in detail in conjunction with FIGS. 1–3. In the illustrated embodiment, the spacing of each tooth from the rotation axis is approximately equal to the length of the tooth, rather than the minimal one-quarter ratio described above in conjunction with FIGS. 1–3.

Figure 25A:
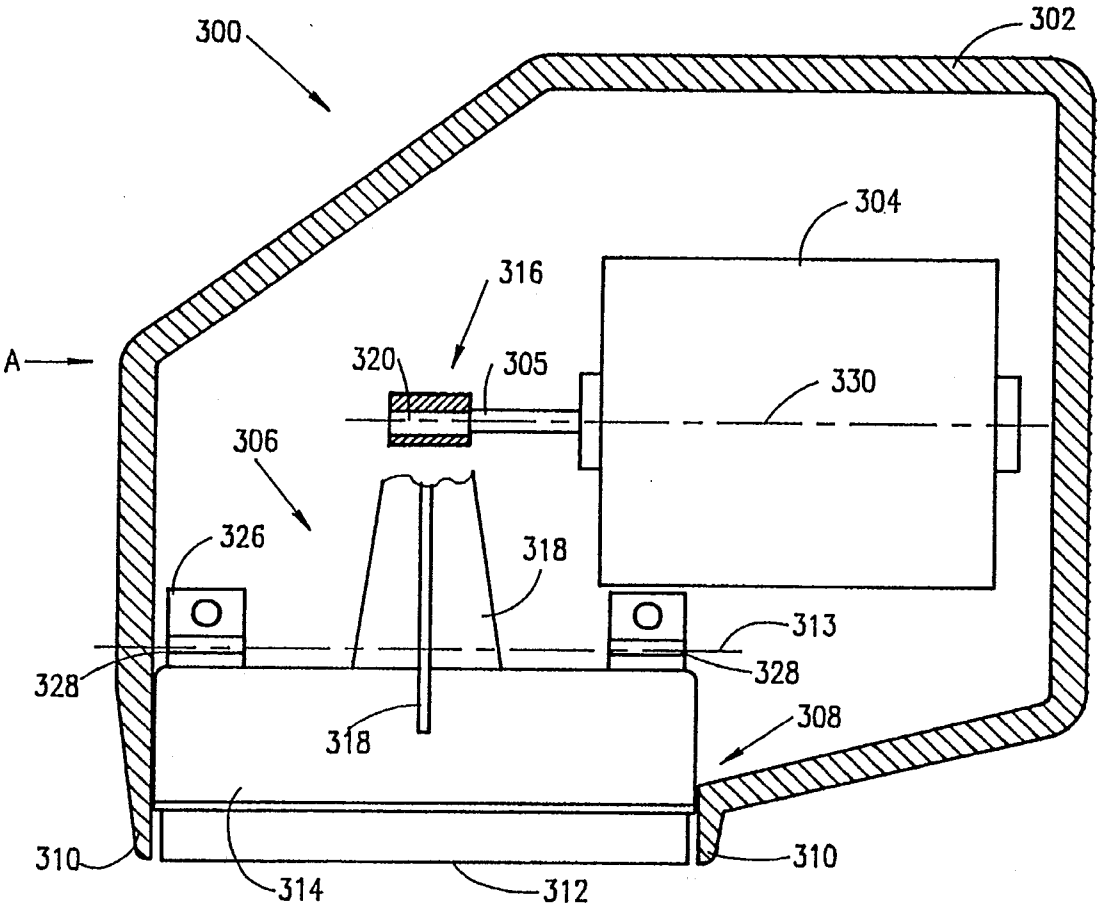
FIG. 25A is a cut-away side view illustration of hair treatment apparatus constructed according to a further embodiment of the invention.
Figure 25B:
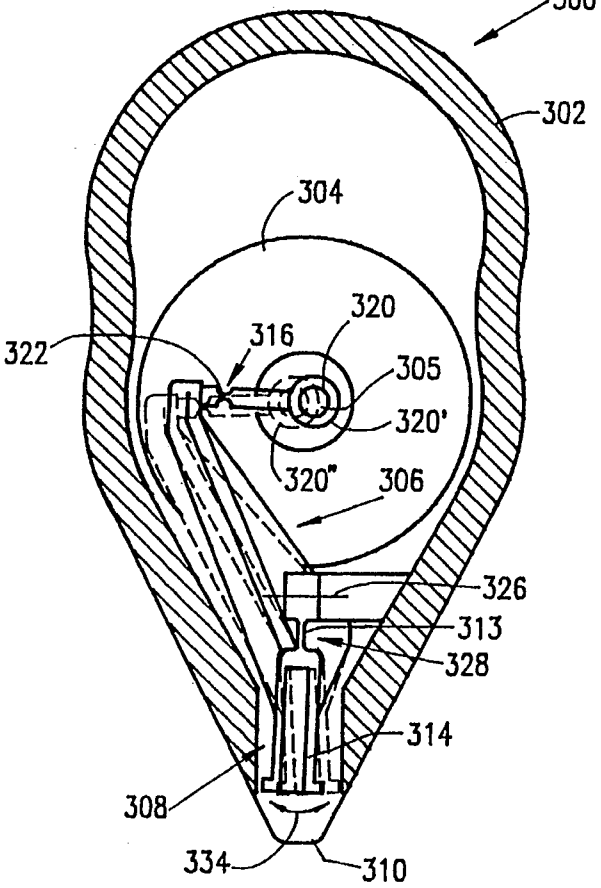
FIG. 25B is a cut-away end view of the apparatus illustrated in FIG. 25A, taken in the direction of arrow A therein.

Reference is now made to FIGS. 25A and 25B, in which is illustrated a hair treatment device, referenced generally 300, whose operation is similar to that of apparatus 200, illustrated and described above in conjunction with FIGS. 19A–20B.

Figure 26B:
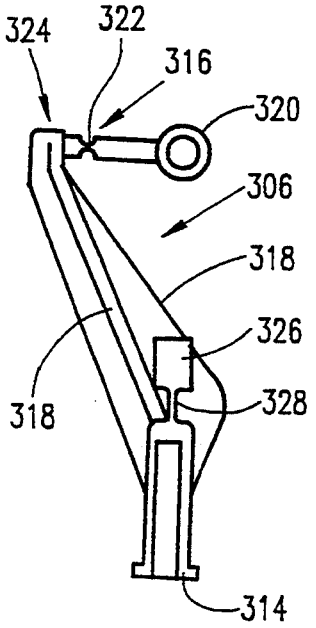
FIGS. 26A and 26B are respective side and end views of a one-piece integral transmission element employed in the apparatus depicted in FIGS. 25A and 25B.
Figure 26A:
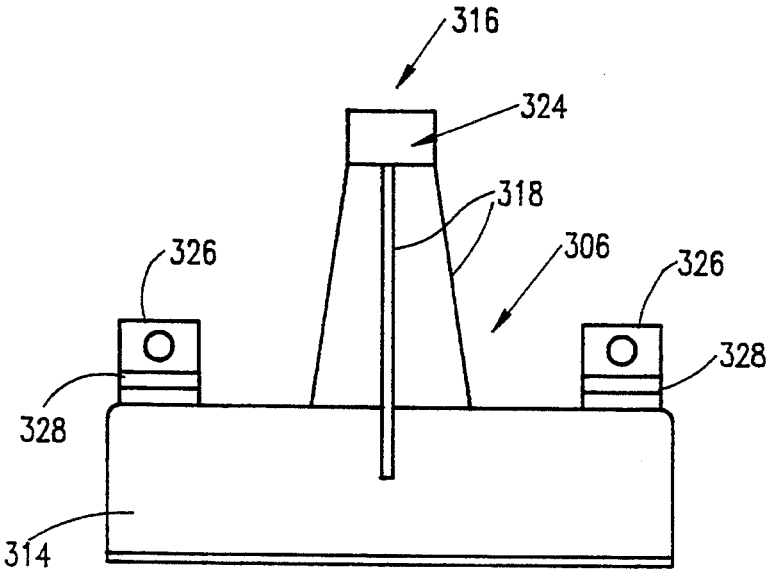

Device 300 includes a housing 302 in which are located a motor 304 having a cranked rotor 305, and a one-piece transmission element 306 (also illustrated in FIGS. 26A and 26B). Motor 304 is typically similar to motor 14 as illustrated and described above in conjunction with FIGS. 1–7. Housing 302 defines an opening 308 between a pair of fixed, tooth-like protrusions 310, which are generally similar to protrusions 212 of apparatus 200 (FIGS. 19A–20B). A comb element 312 (FIG. 25A), similar to comb element 214 (FIGS. 19A and 20A) is mounted, as described below, so as to extend through opening 308, and so as to be rotatable about a rotation axis 313.

Referring now also to FIGS. 26A and 26B, transmission element 306 is characterized by being formed of a single piece of a resilient material, such as a suitable plastic, and defines a comb holder 314 for removably holding a comb element 312, a rotor engagement portion 316, and ribs 318 connecting holder 314 to portion 316. Rotor engagement portion 316 is typically a generally elongate member oriented generally at right angles to rotor 305. Portion 316 defines a sleeve-like portion for receiving rotor 305, and further defines a first integral hinge 322 (FIGS. 25B and 26B), parallel to sleeve 320. Ribs 318 and rotor engagement portion converge at a junction location 324.

Holder 314 is secured to housing 302 via tabs 326, in which are formed second integral hinges 328 defining rotation axis 313 (FIGS. 25A and 25B), parallel to motor axis 330 (FIG. 25A).

As motor 304 is operated, cranked rotor 305 describes a generally circular path of rotation about motor axis 330. Extreme lateral limits of the motion thus imparted to sleeve 320 of rotor engagement portion 316 are illustrated in FIG. 25B by respective solid line and broken line positions, respectively referenced 320' and 320''.

As transmission element 306 is formed from a single piece of resilient material, as described, and due to the presence of first hinge 322 and second hinges 328, as the motor is operated and rotor engagement portion 316 is oscillated as shown and described above in conjunction with FIG. 25B, holder 314 and comb element 312 are oscillated accordingly about rotation axis 313, providing a comb element motion analogous to that of comb elements 214, as shown and described above in conjunction with FIG. 19A. The oscillation of comb element 312 is indicated schematically by double-headed arrow 334 (FIG. 25B).

The precise construction of and the functional relationship between the comb elements 312 and the fixed protrusions 310, is similar to the construction of and the functional relationship between their respective counterpart components of apparatus 200 (FIGS. 19A–20B), and are, therefore, not described in detail herein. Similarly, the operating conditions and function of apparatus 300 are similar to those of apparatus 200 and are thus not described herein.

Figure 27:
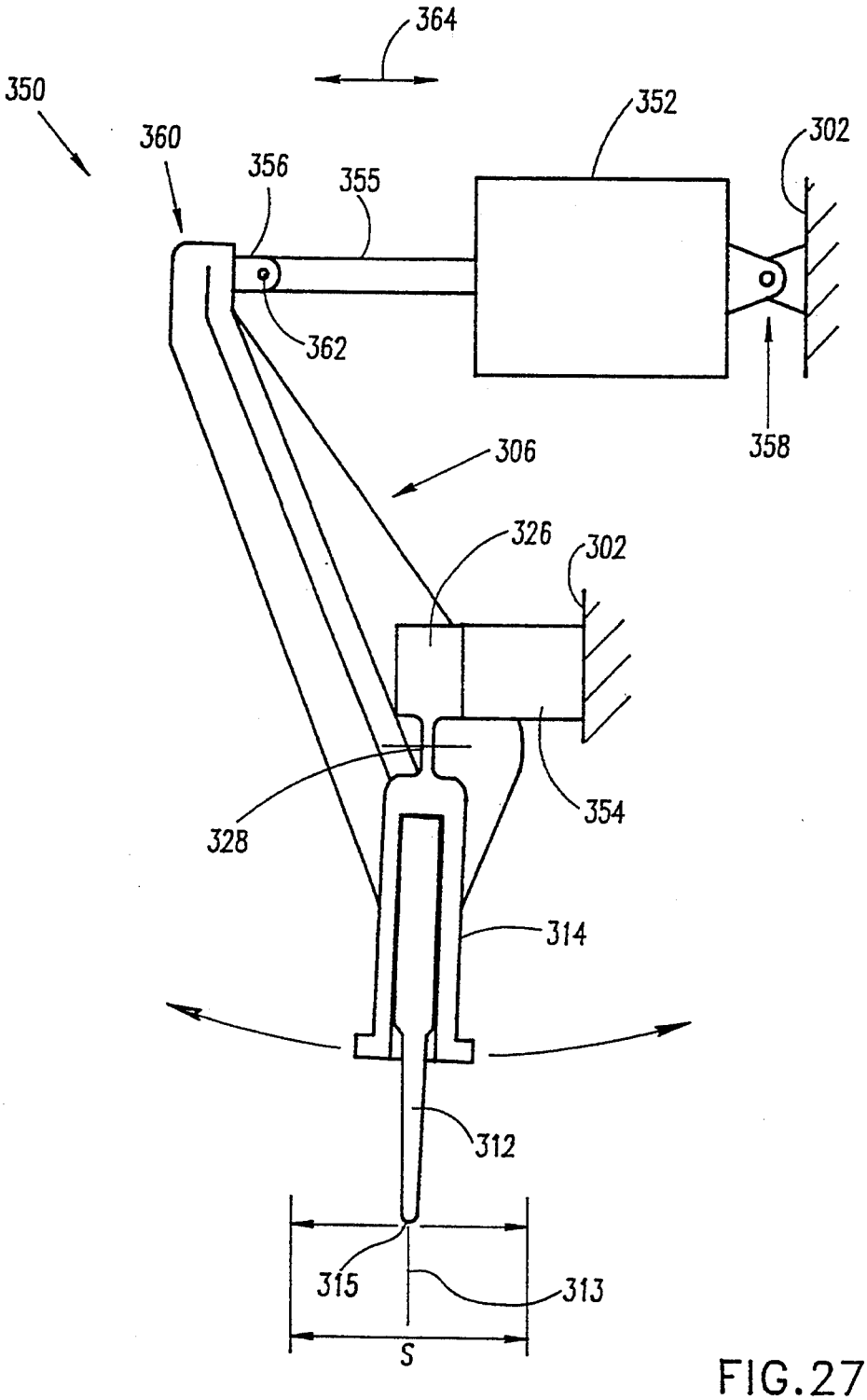
FIG. 27 is a schematic side view illustration of a drive system providing an oscillatory motion similar to that provided by the drive system of the hair treatment apparatus of FIGS. 25A and 25B, but employing an electromagnetic actuator.

Reference is now made to FIG. 27 which illustrates a drive system 350, employing transmission element 306 and an electro-magnetic actuator 352. Transmission element 306 is illustrated in and described above in detail in conjunction with FIGS. 25A–26B, and thus requires no further description herein, except as required for the understanding of the present embodiment.

In the present embodiment, tabs 326 are affixed, as by any appropriate means 354, to housing 3©2. Electromagnetic actuator 352, which may employ any suitable AC powered electromagnet, is secured, via a drive bar 355 and a first hinged connection 356, to an upper portion 360 of the transmission element 306, so as to define therewith a hinge 362, similar to first hinge 322, shown and described above in conjunction with FIGS. 25A and 26A. Electro-magnetic actuator 352 is also secured to housing 302, via a second hinged connection 358.

It will be appreciated that operation of the electromagnetic actuator 352 provides a back and forth, axial motion of drive bar 355, as indicated by arrow 364, providing a corresponding oscillation of comb holder 314 about hinge 328.

It will further be appreciated that, although the drive systems of the embodiments of FIGS. 25A–27 have been described as being used in apparatus employing scalp protection apparatus in the form of fixed protrusions 310 (FIGS. 25A and 25B), these drive systems may also be used in conjunction with hair treatment apparatus not employing scalp protection apparatus. Where this is the case, the overall stroke length S of the free ends 315 of comb teeth 312 (FIG. 27) is preferably limited to no more than about 8 mm, while being oscillated at a speed typically greater than 4,000 cycles per minute, and preferably greater than approximately 4,750 cycles per minute.

Figure 28B:
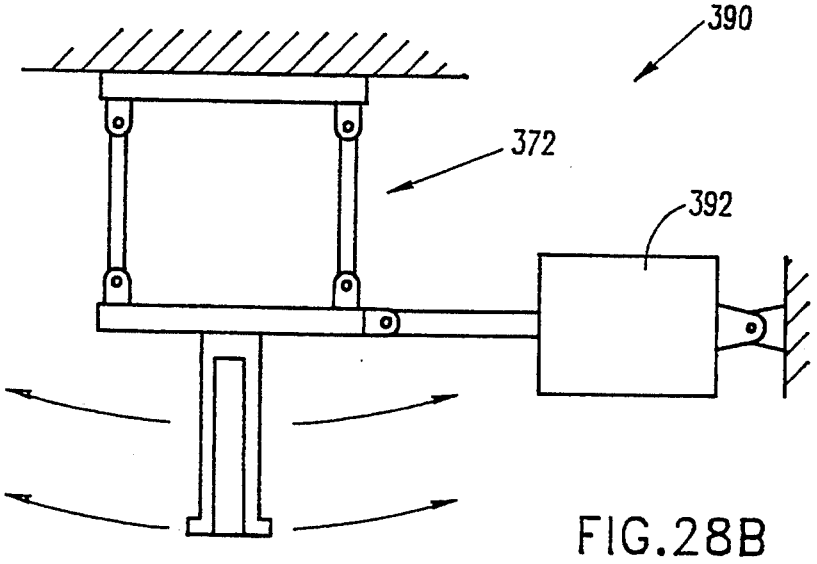
FIG. 28B is a schematic side view illustration of apparatus similar to the apparatus illustrated in FIG. 28A, but employing an electro-magnetic actuator.
Figure 28A:
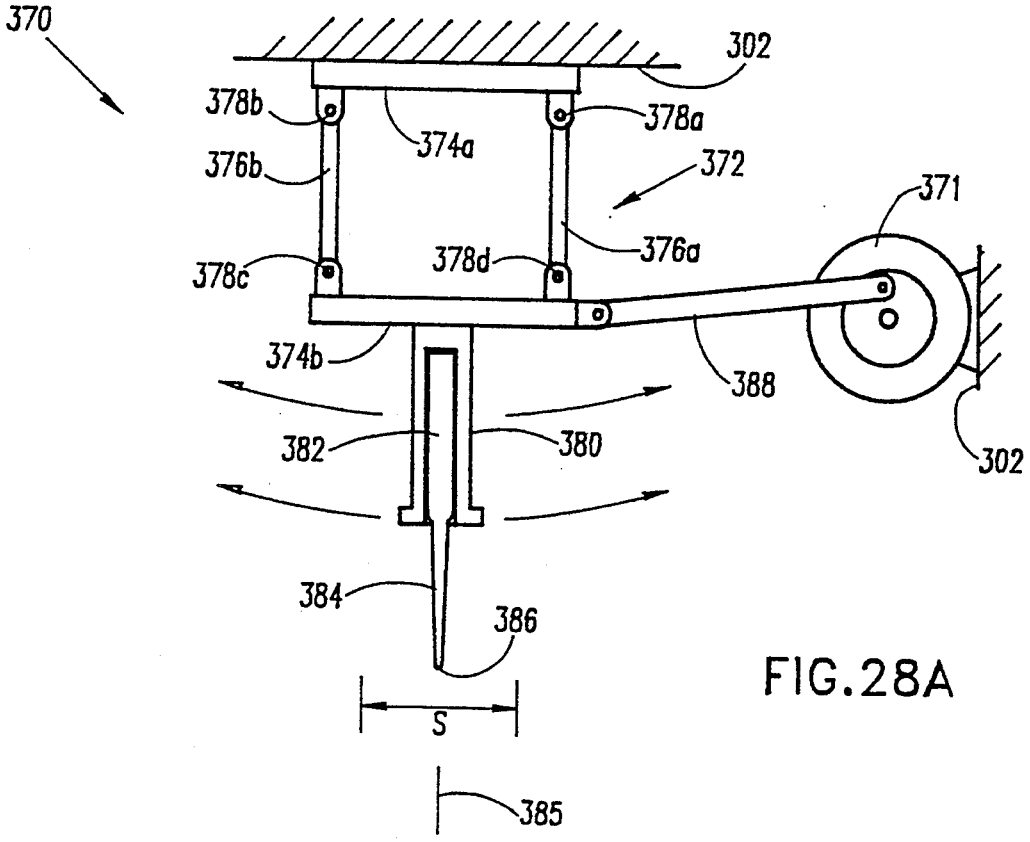
FIG. 28A is a schematic side view illustration of a drive system for use in the hair treatment apparatus of the invention, but wherein the transmission element is configured, in accordance with a further embodiment of the invention, to impart a generally parallel, side-to-side motion to the hair separation apparatus.

Referring now to FIG. 28A, there is illustrated a further drive system, referenced generally 370, suitable for use typically, but not solely, in hair treatment apparatus 300, illustrated and described above in conjunction with FIGS. 25A and 253. Drive system 370 includes an electric motor 371, secured to a portion of housing 302, and a transmission element 372, also secured to housing 302. The transmission element 372 has two pairs of parallel sides, referenced **374*a* and 374*b* and 376*a* and 376*b*, defining hinges 378*a*, 378*b*, 378*c* and 378*d* at the respective junctions therebetween. A comb holder 380 is formed integrally with side 374*b*, and contains a comb 382, having comb teeth 384, (illustrated in side view), each extending along a longitudinal axis 385 and having a free end 386**.

Motor 371 is attached to transmission element 372 via a drive rod 388, and when operated, imparts via transmission element 372, a quasi-parallel, side-to-side oscillation to comb holder 380 and, correspondingly, to comb teeth 384.

Drive system 370 may be used either with hair treatment apparatus having scalp protection apparatus, such as the apparatus 300 illustrated in FIGS. 25A and 253, or with hair treatment apparatus which does not include scalp protection apparatus, such as with apparatus 10 of either of FIGS. 1 or 2, for example. When the drive system is employed in hair treatment apparatus not employing scalp protection apparatus, the overall stroke length S of the free ends 386 of comb teeth 384 is preferably limited to no more than about 8 mm, while being oscillated at a speed of typically greater than 4,000 cycles per minute, and preferably greater than about 4,750 cycles per minute.

Referring now briefly to FIG. 28B, there is shown a drive system 390 which is similar to drive system 370, described above in detail in conjunction with FIG. 28A, except that the present drive system 390 employs an electro-magnetic actuator 392, similar to electromagnetic actuator 352 of drive system 350 (FIG. 27), rather than an electric motor. The motion provided by drive system 390 is similar to that provided by drive system 370 and, accordingly, no further description of drive system 390 is provided herein.

Figure 29B:
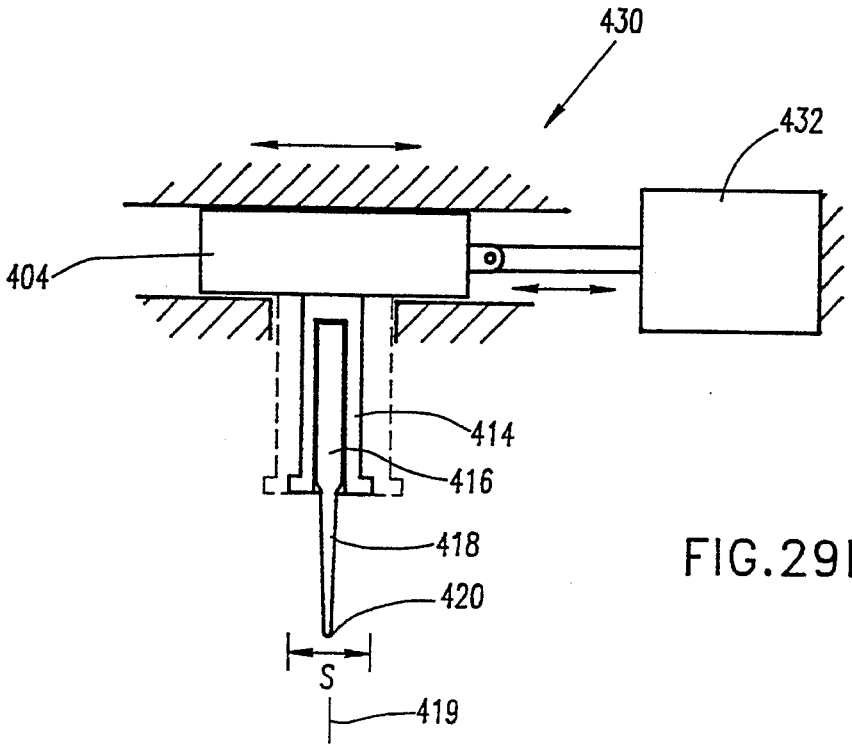
FIG. 29B is a schematic side view illustration of apparatus similar to the apparatus illustrated in FIG. 29A, but employing an electro-magnetic actuator.
Figure 29A:
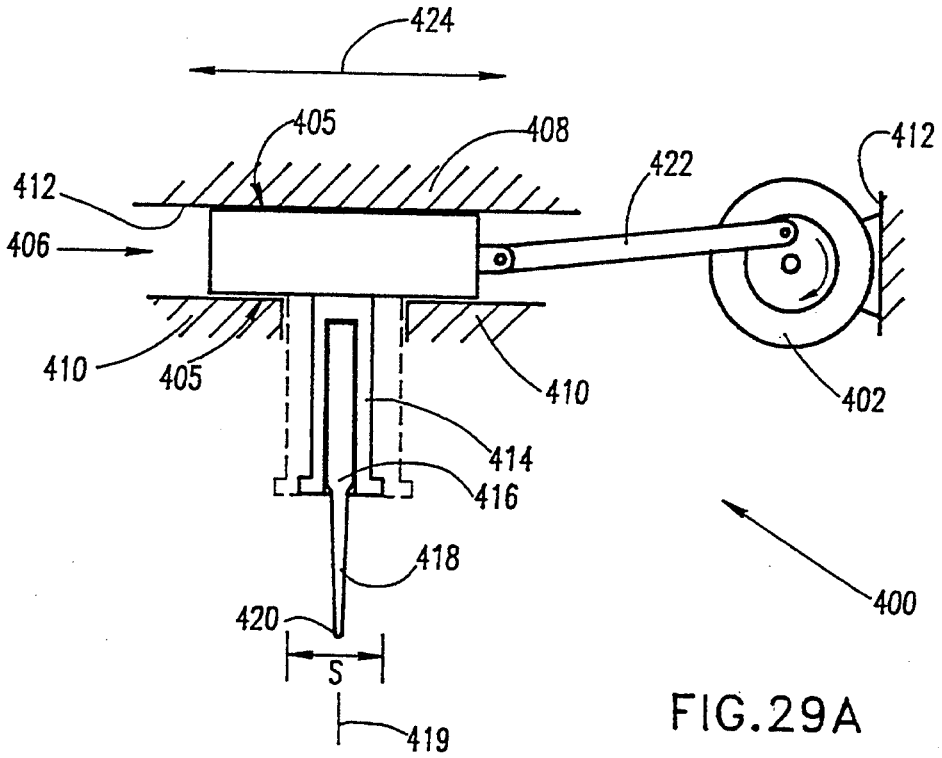
FIG. 29A is a schematic side view illustration of a drive system for use in the hair treatment apparatus of the invention, but wherein the transmission element is configured, according to an alternative embodiment of the invention, to impart a parallel, side-to-side motion to the hair separation apparatus.

Referring now to FIG. 29A, there is illustrated a further drive system, referenced generally 400, suitable for use typically, but not only, in hair treatment apparatus 300, illustrated and described above in conjunction with FIGS. 25A and 25B. Drive system 400 includes an electric motor 402, secured to a portion of a housing 412, and a slider element 404 defining parallel sides 409, arranged for reciprocal sliding movement along a linear channel portion 406 defined by channel members 408 and 410 secured to housing 412. A comb holder 414 is affixed to slider element 404, and contains a comb 416, having comb teeth 418 (illustrated in side view), each extending a longitudinal axis 419 and having a free end 420.

Motor 402 is attached to slider element 404 via a drive rod 422, and when operated, causes a back and forth oscillation of slider element 404 within linear channel portion 406, a similar parallel, side-to-side oscillation being imparted to comb holder 414 and, correspondingly, to comb teeth 418. The side-to-side motion of slider element 404 within channel portion 406 is depicted diagrammatically by double-headed arrow 424, the extent of the side-to-side oscillation of comb holder 414 being depicted in broken outline, and the limits of oscillation of tooth ends 420 are indicated by the stroke length S.

Drive system 400 may be used either with hair treatment apparatus having scalp protection apparatus, such as the apparatus 300 illustrated in FIGS. 25A and 25B, or with any suitable hair treatment apparatus which does not include scalp protection apparatus. When the drive system is employed in hair treatment apparatus not employing scalp protection apparatus, the overall stroke length S of the free ends 420 of comb teeth 418 is preferably limited to no more than about 8 mm, while being oscillated at a speed of typically greater than 4,000 cycles per minute, and preferably greater than 4,750 cycles per minute.

Referring now briefly to FIG. 29B, there is shown a drive system 430 which is similar to drive system 400, described above in detail in conjunction with FIG. 29A, except that the present drive system 430 employs an electro-magnetic actuator 432, similar to electromagnetic actuator 352 of drive system 350 (FIG. 27), rather than an electric motor. The motion provided by drive system 430 is similar to that provided by drive system 400 and, accordingly, no further description of drive system 430 is provided herein.

Figure 30:
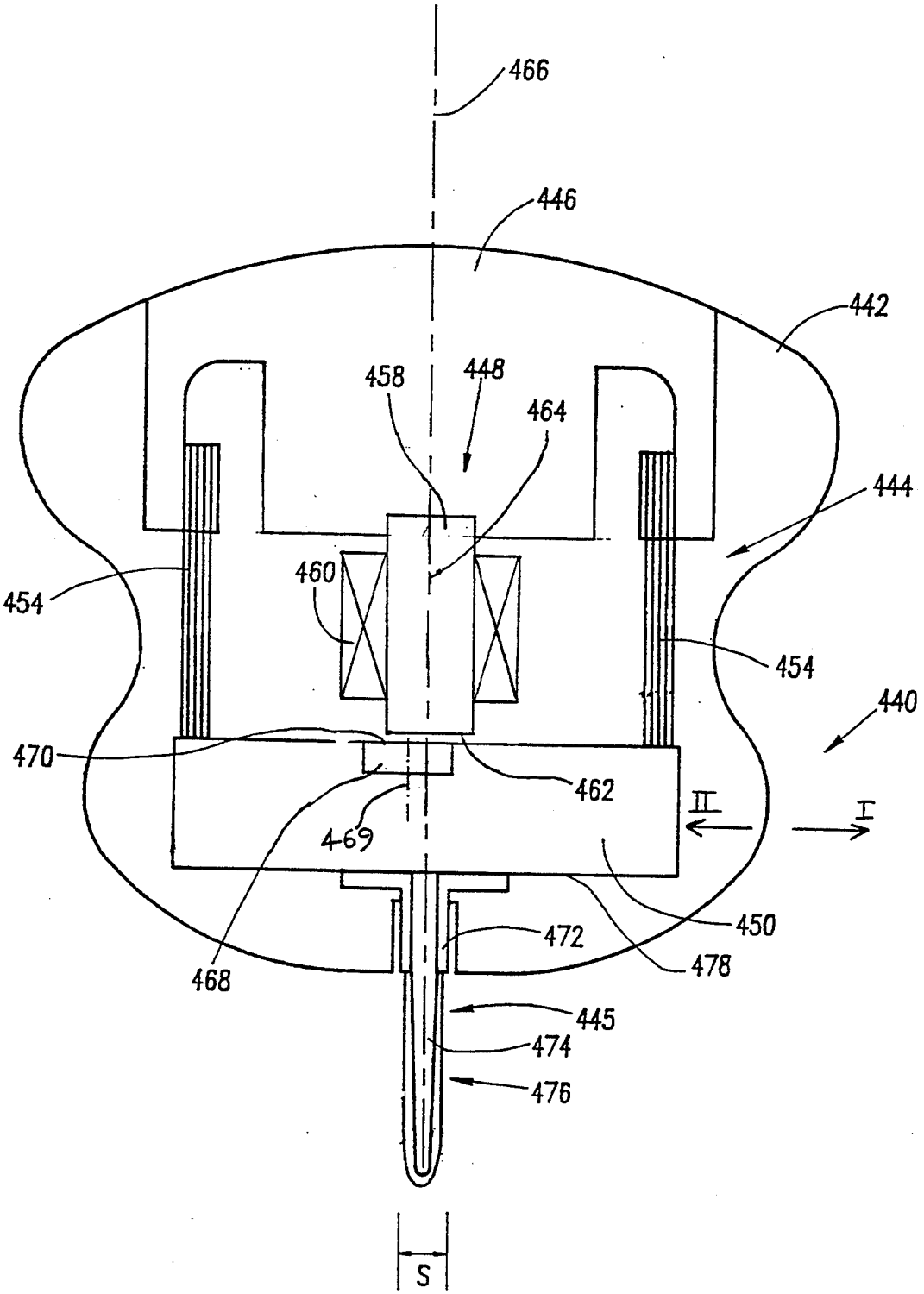
FIG. 30 is a schematic illustration of electromagnetically magnetically driven hair treatment apparatus employing an internally balanced drive system, constructed and operative in accordance with an embodiment of the invention.

Reference is now made to FIG. 30, in which is illustrated hair treatment apparatus, referenced generally 440, having a housing 442, a drive system 444 mounted onto housing 442, and hair separation apparatus 445, typically a hair comb or lice comb.

Drive system 444 includes a mounting block 446 rigidly secured to housing 442, an electromagnetic drive 448 and a transmission block 450. Drive 448 is rigidly secured to mounting block 446, while transmission block 450 is attached thereto via a pair of resilient members 454. Resilient members 454 are typically leaf springs.

Electromagnetic drive 448 includes a magnetic core 498 rigidly secured to mounting block 446 and an electric coil 460 which surrounds core 458. Magnetic core 458 has a generally flat free end surface 462. Magnetic core 458 and coil 460 are mounted such that their common longitudinal axis 464 is coincident with an axis of symmetry 466 of drive system 444.

Transmission block 450 has mounted therein a permanent magnet 468, defining a planar surface 470 parallel to end surface 462 of magnetic core 458. Permanent magnet is arranged such that an axis of symmetry thereof, referenced 469, is offset laterally from axis of symmetry 466 of the drive system 444. Hair separation apparatus 449, typically including a holder 472, a comb portion 474, and scalp protection apparatus 476, is rigidly attached to an outward face 478 of transmission block 450. The hair separation apparatus 445 is aligned longitudinally along axis of symmetry 466 of the drive system 444.

When electric coil 460 is connected to a source of alternating current (AC) (not shown), magnetic core 458 becomes magnetized such that end surface 462 thereof has a polarity that alternates at a frequency corresponding to the frequency of the AC source. Accordingly, the polarity of end surface 462 is alternately the same as and opposite to that of permanent magnet 468.

At the portion of the electrical phase when end surface 462 of core 458 has a polarity the same as that of the permanent magnet 468, core 458 and magnet 468 are mutually repelled. As drive 448 is secured rigidly to mounting block 446 and the transmission block 450 is arranged such that it may be moved sideways only, the transmission block 450, to which hair separation apparatus 445 is attached, is repelled sideways, substantially at fight angles to axes 464, 466 and 469. This motion is indicated in FIG. 30 by arrow "I".

Correspondingly, at that portion of the electrical phase when end 462 of core 458 has a polarity opposite to that of the permanent magnet 468, core 458 and magnet 468 thus being mutually attracted, an opposite sideways movement of magnet of transmission block 450 results. This motion is indicated in FIG. 30 by arrow "II".

The side-to-side oscillation of transmission block 450 results in a corresponding, side-to-side oscillation of hair separation apparatus 445. According to the present embodiment, holder 472 has integrally formed therewith scalp protection apparatus 476, constituted by protrusions 480, similar to protrusions 310, shown and described above in conjunction with FIGS. 25A and 25B.

In an alternative embodiment, protrusions 480 need not be provided, although, in that case, the stroke length S should preferably not exceed 8 mm, and the oscillation speed should be greater than 4,000 cycles per minute, and preferably greater than 4,750 cycles per minute, as described at length hereinabove.

Figure 31:
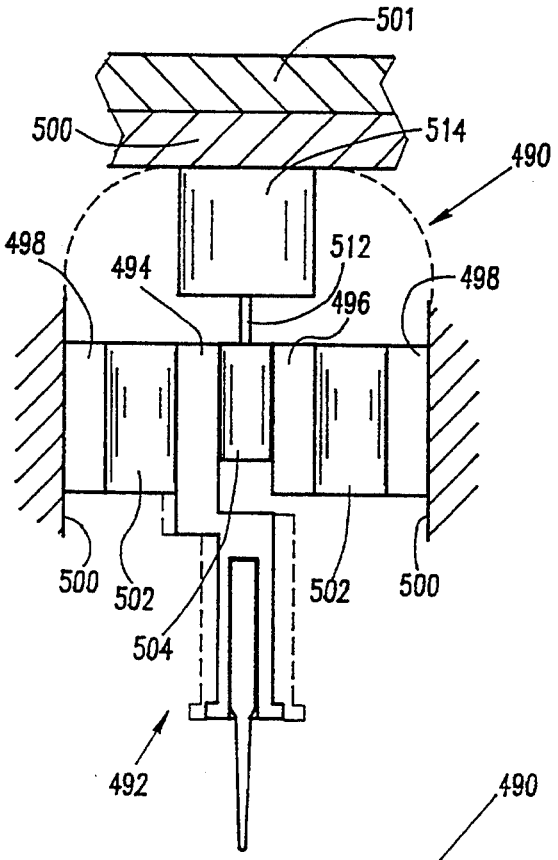
FIG. 31 is a schematic side view of an internally balanced drive system employing an electro-mechanical actuator.
Figure 32:
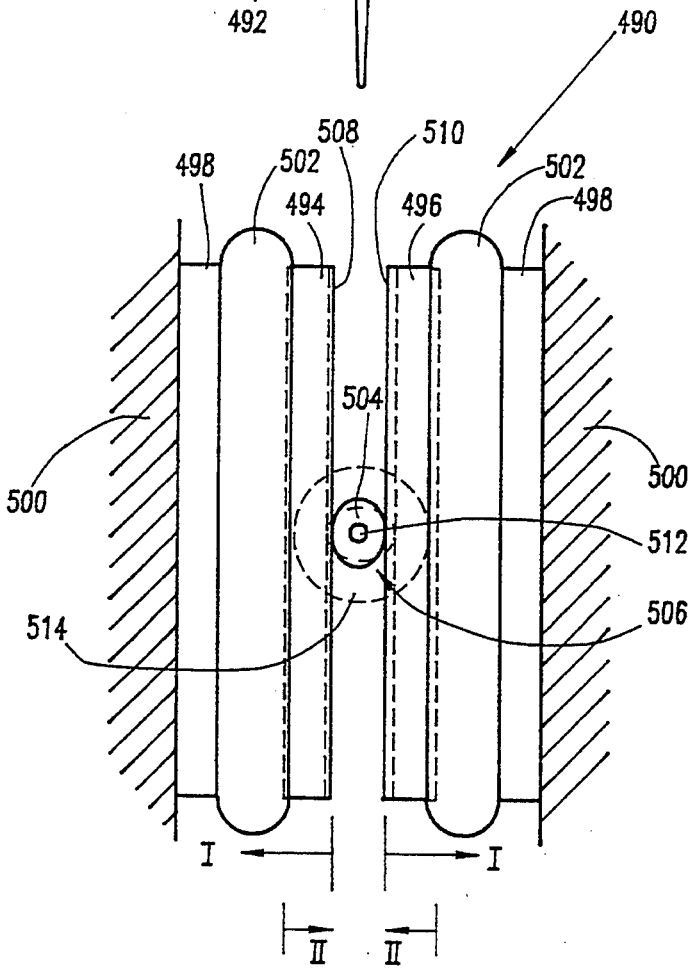
FIG. 32 is a schematic cross-sectional view of the drive system of FIG. 31.

Reference is now made to FIGS. 31 and 32, in which is illustrated, in respective side and sectional views, an internally balanced drive system 490, useful for driving hair separation apparatus 492 (FIG. 31), in accordance an embodiment of the present invention. Hair separation apparatus 492 is typically a hair comb or a lice comb.

As will become apparent from the ensuing description, drive system 490 is internally balanced. In other words, the net force applied by the drive system to its support, namely, housing 501, is negligible. In other words, when drive system 490 is in an energized state, if no external force is applied to the hair separation apparatus 492, virtually no vibrations will be felt by a user holding the hair treatment apparatus by its housing 501.

Drive system 490 includes a pair of similar, relatively rigid, parallel plate members, referenced 494 and 496. Hair separation apparatus 492 is connected to one of the plate members, in the present example, plate member 494. Preferably, the combined mass of the hair separation apparatus 492 and the plate member to which it is connected, is equal to the mass of the other plate member. Each plate member is spaced from, and positioned so as to be typically parallel to, an associated mounting member 498. The two illustrated mounting members 498 are secured to a common base 500, which, as depicted schematically in FIG. 31, is secured to a housing 501. Between each of plate members 494 and 496 and its associated mounting member, is a resilient element 502, such as a suitable spring or a portion of resilient material, such as foam rubber, for example.

A non-circular, generally rounded, typically elliptical, cylindrical spacer element 504 is arranged between plate members 494 and 496, such that the exterior surface 506 of element 504 continually in touching contact with opposing surfaces 508 and 510 of the plate members 494 and 496. The spacer element 504 is mounted onto the drive shaft 512 of a suitable electric motor 514, so as to be rotated thereby. Electric motor 514 is also secured to base 500.

Typically, the 'width' of spacer element 504 (the dimension taken along the minor axis, if element 504 is elliptical), is equal to the spacing between surfaces 508 and 510 of the plate members 494 and 496 when they are in an 'at rest' position.

As element 504 is rotated through 90°, plate members 494 and 496 are forced apart, to the position shown in broken lines, against the urging of resilient members 502, until the spacing between respective surfaces 508 and 510 thereof is equal to the 'length' of spacer element 504 (the dimension taken along the major axis, if element 504 is elliptical). The movement apart of plate members 494 and 496 is indicated in FIG. 32 by opposing arrows "I".

As element 504 is rotated through a further 90°, plate members 494 and 496 are permitted once again to move towards each other, under the urging of resilient members 502, until the spacing between respective surfaces 508 and 510 thereof is once again equal to the 'width' of spacer element 504. The movement together of plate members 494 and 496 is indicated in FIG. 32 by opposing arrows "II".

It will be appreciated that the above-described drive system is thus internally balanced, and, further, is operative to provide a side-to-side parallel motion of hair separation apparatus 492. Apparatus 492 is substantially as described in accordance with any of the embodiments shown and described in conjunction with FIGS. 19A–20B, and 25A–25B, and is not, therefore, described herein in detail.

Figure 33:
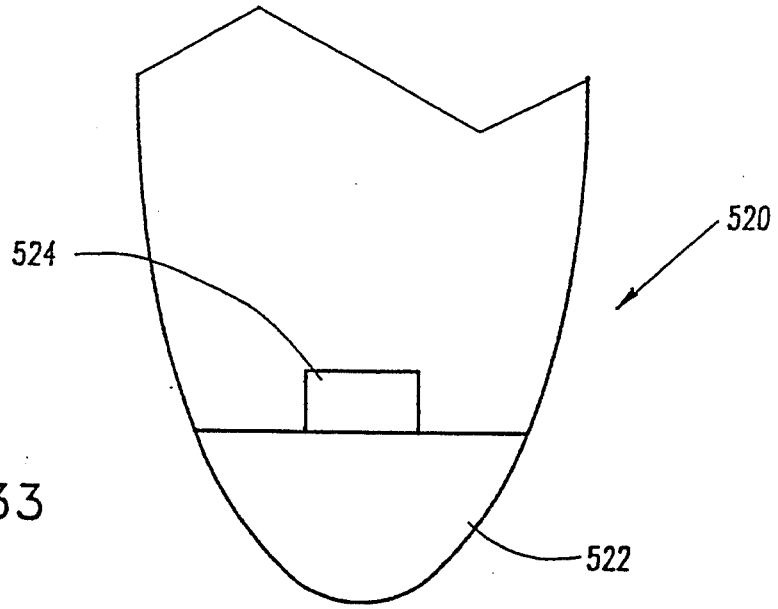
FIG. 33 is an enlarged detail of the end portion of the fixed protrusions of the apparatus illustrated in FIGS. 19A–20B, 25A–25B, and 30 in accordance with an additional embodiment of the invention.

Reference is now made to FIG. 33, in which is illustrated an enlarged detail of an end portion of a fixed protrusion 520, such as any of the fixed protrusions which constitute the scalp guard in any the embodiments of the hair treatment apparatus shown and described above in conjunction with FIGS. 19A–20B, and 25A–25B. According to the illustrated embodiment, a resilient end portion, referenced 522, which acts as a shock absorber and is thus operative to reduce vibrations that might otherwise be conducted to the scalp via the fixed protrusions. Typically, resilient end portion 522 is a portion of an elastomer bonded, or otherwise secured, to a suitably configured socket portion 524 formed on fixed protrusion 520.

Figure 34:
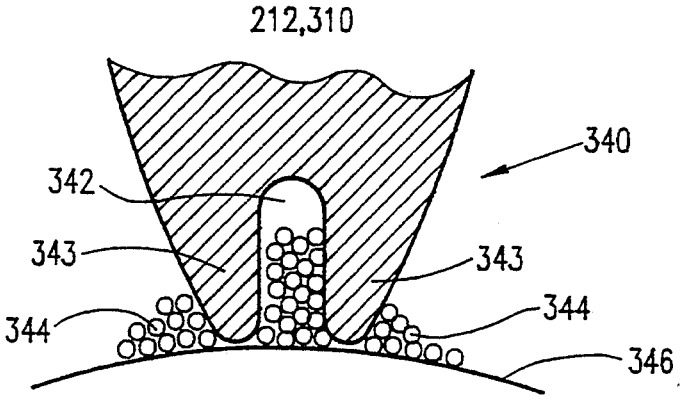
FIG. 34 is an enlarged detail of an alternative configuration of an end portion of the fixed protrusions illustrated in FIGS. 19A–20B, 25A and 25B.

Referring now to FIG. 34, there is illustrated, in enlarged form, an end portion 340 of fixed protrusions 212 (FIGS. 19A–20B) and 310 (FIGS. 25A and 25B), but configured in accordance with an alternative embodiment of the invention. As described hereinabove, an important feature of the operation of the hair treatment apparatus of the present invention is the operation of the oscillating comb element at, or very close to, the scalp.

According to the present embodiment, therefore, end portion 340 defines a groove 342, thereby dividing portion into a pair of relatively narrow teeth 343. As the hair treatment apparatus is introduced into a plurality of hairs 344, a very close approach of the fixed protrusion to the scalp 346 is enabled by the displacement of hairs 344 either to the outward facing sides of teeth 343, or into groove 342 defined between teeth 343. This clearly provides for access to the scalp that is better than that provided by the configuration illustrated in FIGS. 19A–20B, 25A and 25B, wherein the hairs can be displaced to the sides of the fixed protrusion only.

Figure 21:
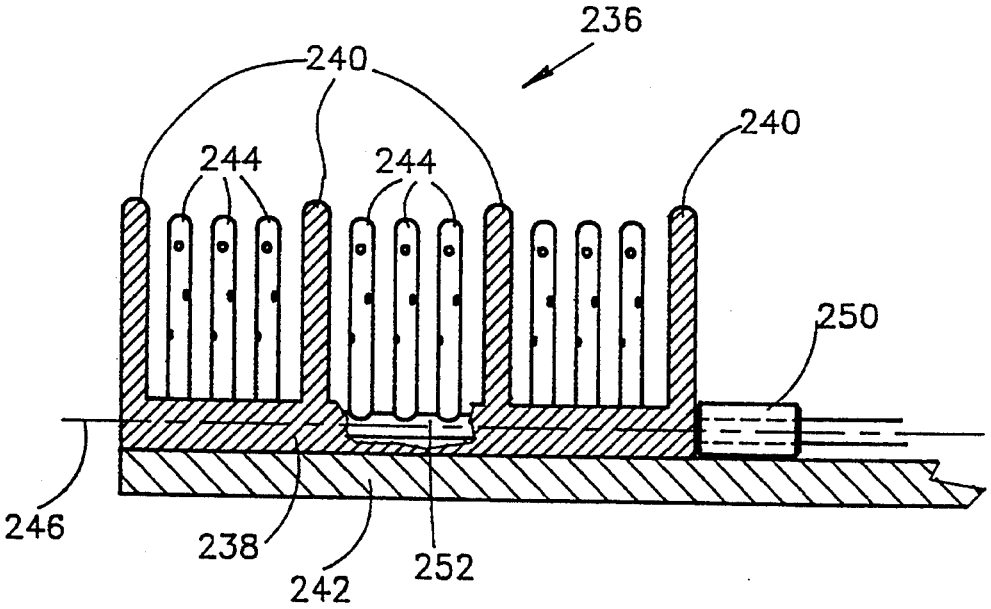
FIG. 21 shows a head portion useful with the apparatus of FIGS. 20A and 20B, wherein the head portion has been constructed so as to permit the dispensing of liquids therefrom.

Reference is now made to FIG. 21, which shows the head portion 236 of apparatus similar to device 200 (FIGS. 19A–20B), but wherein the head portion is constructed so as to permit the dispensing of liquids therefrom. The use of liquids may include the use of any liquid having a potentially beneficial effect on the hair and/or scalp of the user, and include the use of known chemical preparations for eliminating lice and their eggs as a supplement to the use of the apparatus of the invention. Head portion 236 thus includes a base 238 defining a plurality of protrusions 240, similar to protrusions 212 of base 206 described above in conjunction with FIGS. 19A–20B, and a cover 242 for the base.

A plurality of teeth 244 are also provided, being shorter and narrower than protrusions 240, and being reciprocally rotatable about an axis 246. The limits of the reciprocal rotation of teeth 244 relative to the protrusions 240, are similar to those described above for teeth 216 relative to protrusions 212 (FIG. 19B) and are thus not described here in detail.

Figure 22:
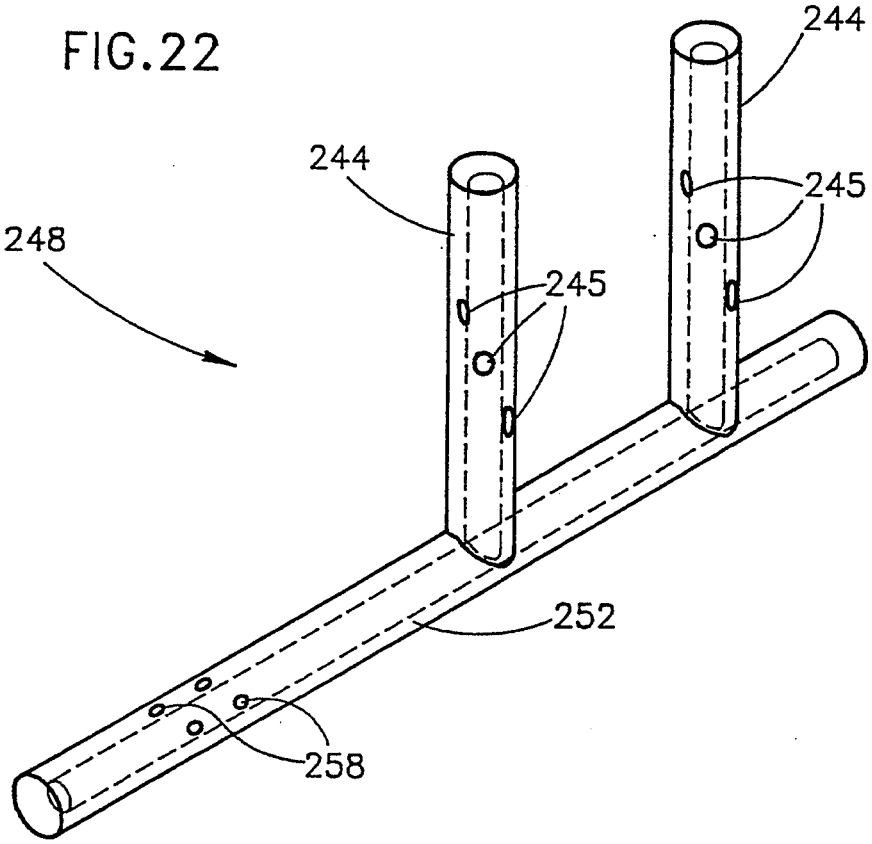
FIG. 22 is a schematic, enlarged, perspective view of a portion of a conduit system used in the modified head of FIG. 21.

Referring additionally to FIG. 22, each tooth 244 is hollow and defines a number of liquid outlet apertures 245, which permit dispensing of a liquid at predetermined points along the length of the teeth 244. Hollow teeth 244 form part of a conduit system 248, whereby each tooth 244 is connected to a container 250 containing a liquid for dispersal in the hair, via a rigid main distribution tube 252, arranged within base 238 and lying along rotation axis 246.

Referring also to FIGS. 23–24B, tube 252 extends through container 250 and is operative to be reciprocally rotated by a motor (not shown), such as motor 204 described in conjunction with the embodiment of FIGS. 19A–20B. Container 250 typically is a drum defining an interior annular volume which is arranged about tube 252. Liquid is permitted to enter tube 252 via outlet ports 254 provided in an inner wall 256 of the container and inlet ports 258 provided in a portion of tube 252 surrounded by inner wall 256 of the container. Container 250 is preferably rotatable about tube 252, so that the outlet ports 254 of the container can be moved out of alignment with the inlet ports 258 of the tube 252, as illustrated in FIG. 24B, so as to prevent undesired flow of liquid.

Even when outlet ports 254 and inlet ports 258 are in alignment, as illustrated in FIG. 24A, liquid will not flow freely unless pressure is applied to the liquid in the container, such as by means of a piston member 260 (FIG. 23). A flow control 262 is provided for selectably moving the piston member (FIG. 23) in the direction indicated by arrow A (FIG. 23). Container 250 also includes an opening 264 permitting refilling with a selected liquid. It will be appreciated that the container 250 and piston member 260 used in conjunction therewith constitute just one example of a system for supplying a liquid to teeth 244 for dispersal in the hair, and that any suitable system may be employed for this purpose.

Reference is now made to FIG. 35, in which is illustrated a portion of hair treatment apparatus, referenced generally 530, constructed in accordance with an alternative embodiment of the invention. It will be appreciated that, although only a portion of apparatus 530 is illustrated, its structure and operation may be generally similar to any of the embodiments shown and described above in conjunction with FIGS. 4A–4E, 6A–6B, 8A–8C, 19A–30 and 31 and 32, except as described specifically herein.

Apparatus 530 thus includes a housing 532 and a plurality of hair separation teeth 534, which may be mounted for either rotational oscillation about an axis 536, or for parallel, side-to-side, generally parallel oscillation, such as indicated by broken-line double headed arrow 538- Hair separation teeth 534 are typically components of a hair comb or a lice comb.

According to the present embodiment, a small number of the hair separation teeth 534 have mounted onto free ends 535 thereof a spacer element 540 which, as illustrated in FIG. 36B, ensures that a predetermined minimum spacing is always maintained between the tooth ends 535 and a user's scalp 542.

Referring now to FIG. 36A, which is a cross-section of a spacer element 540 and tooth end 535, and to FIG. 36B which is a side-section of a spacer element 540 and tooth end 535, spacer element 540 is a bow-shaped element having defined therein a channel 544, communicating with the exterior via a relatively narrow, elongate opening 546 parallel to the channel.

Each of a small number of the tooth ends 535, at a predetermined spacing, is configured such that it may have a spacer element 540 loosely secured thereto. Accordingly, when hair treatment apparatus 530 is introduced into the hair of a user, and the spacer elements 540 are placed on the user's scalp 542, the relative freedom of movement of the tooth ends 535 within the spacer element channels 544, combined with the relatively high speed of oscillation of the teeth 534 and the relatively high friction between a bottom surface 548 of each of the spacer elements 540 and the scalp 542, allow the tooth ends to oscillate freely inside the spacer elements 540, with very little motion being imparted to the spacer elements.

Typically, the comb teeth 534 and the spacer elements 540 are made of a resilient plastic, the tooth ends 535 to which the spacer elements are to be secured have a generally rounded configuration, as depicted by reference numeral 550. The rounded tooth ends 550 have external dimensions that are greater than the width of elongate opening 546 but smaller than the width of channel 544. The tooth portion 552 adjacent to the rounded portion 550 is formed so as to be narrower than the elongate opening 546. Accordingly, the spacer elements 540 may be simply snapped on to the rounded tooth ends 550 so as to become loosely secured thereto.

It will be appreciated by persons skilled in the art that the present invention is not limited by what has been particularly shown and described hereinabove. The scope of the invention is limited, rather, solely by the claims, which follow.

We claim:

1. A lice comb for treating and systematically delousing hair comprising:

a handle;

hair separation means including:

a single elongate base means associated with said handle; and a plurality of closely spaced parallel teeth attached to said base means and extending transversely therefrom, each of said parallel teeth having a free end; and drive means for oscillating said plurality of teeth at a frequency of at least about 4,750 cycles per minute and for limiting a stroke of said free end of each said tooth to a length of no greater than approximately 8 mm, and for bringing said plurality of teeth into repeated engagement with a group of hairs attached to skin, thereby easing passage of said hair separation means through the group of hairs at a level of discomfort tolerable to a user while at the same time striking and pulling any lice and lice eggs from said hair at high speed causing them fatal injury.

2. Apparatus according to claim 1, and wherein each said tooth has a longitudinal axis and said drive means comprises means for oscillating each said tooth in a direction transverse to its longitudinal axis.

3. Apparatus according to claim 1, and wherein said base means has a longitudinal axis, each said tooth extending transversely therefrom; and said drive means comprises means for oscillating said hair separation means about said longitudinal axis of said base means.

4. Apparatus according to claim 1, and wherein each tooth of said plurality of teeth is attached to said base means so as to be separated from said longitudinal axis by a distance equal to at least one-quarter of the length of a single one of said plurality of teeth.

5. Apparatus for treating hair comprising:

a handle;

hair separation means including:

generally elongate base means associated with said handle; and a plurality of parallel teeth attached to said base means and extending transversely therefrom, each said tooth having a free end; and drive means for oscillating said plurality of teeth at a frequency of at least about 4,750 cycles per minute and for limiting a stroke of said free end of each said tooth to a length of no greater than approximately 8 mm, and for bringing said plurality of teeth into repeated engagement with a group of hairs attached to skin, thereby easing passage of said hair separation means through the group of hairs at a level of discomfort tolerable to a user, said drive means comprising means for imparting to said hair separation means an oscillatory motion having a linear component transverse to said longitudinal axis of said base means and further having rotational component about said longitudinal axis of said base means.

6. Apparatus according to claim 5, and wherein each tooth of said plurality of teeth is attached to said base means so as to be separated from said longitudinal axis by a distance equal to at least one-quarter of the length of a single one of said teeth.

7. Apparatus according to claim 5, and wherein said hair separation means comprises a lice comb.

8. Apparatus according to claim 5, and wherein said means for substantially preventing contact is configured for mounting onto said handle.

9. Apparatus according to claim 5, and wherein said teeth are positioned parallel to and between said transverse protrusions of said means for substantially preventing contact, and said transverse protrusions extend beyond said hair separation elements in a direction parallel to said second axis.

10. Apparatus according to claim 5, and wherein said hair separation means comprises means for engaging at least one of lice and lice eggs located within the hair.

11. A method of treating hair comprising the following steps:

providing hair separation apparatus including a generally elongate base and a plurality of parallel teeth attached to the base and extending transversely therefrom, each tooth having a free end;

oscillating the hair separation apparatus at a frequency of at least 4,750 cycles per minute and so as to provide a stroke of the free ends of the tooth of length no greater than approximately 8 mm;

placing the hair separation apparatus in a group of hairs, each having a length in a given direction; and moving the hair separation apparatus through the hairs in a direction generally transverse to the length of the hair, thereby easing passage of the hair separation apparatus through the hairs without vibrational discomfort to a user.

12. A method according to claim 11, and wherein the elongate base has a longitudinal axis and said step of oscillating comprises oscillating the plurality of teeth such that each tooth is oscillated in a direction transverse to its longitudinal axis.

13. A method according to claim 11, and wherein the base has a longitudinal axis, each of the plurality of parallel teeth extending transversely therefrom; and the step of oscillating comprises oscillating the hair separation apparatus about the longitudinal axis of the base.

14. A method according to claim 11, and wherein said hair separation apparatus is a lice comb and said method of treating hair is a method of delousing hair containing at least one of lice and lice eggs, wherein said oscillating lice comb also repeatedly strikes and pulls any lice and lice eggs from said hair at high speed causing fatal injury to said lice and lice eggs.

15. A method of treating hair comprising the following steps:

providing hair separation apparatus comprising a generally elongate base having a longitudinal axis, and a plurality of elongate teeth attached to the base and oriented transversely to the longitudinal axis;

inparting to the hair separation apparatus an oscillatory motion having a linear component along the longitudinal axis and further having a rotational component about the longitudinal axis;

placing the hair separation apparatus in a group of hairs, each having a length in a given direction; and moving the hair separation apparatus through the hairs in a direction generally transverse to the length of the hair, thereby easing passage of the hair separation apparatus therethrough.

16. A method according to claim 15, and wherein said method of treating hair is a method of delousing hair containing at least one of lice and lice eggs, and said step of imparting an oscillatory motion comprises an additional step of repeatedly engaging at least one of lice and lice eggs located within the hair.

17. A method of delousing hair containing lice and lice eggs comprising the following steps:

providing an apparatus having a lice comb and means for systematically causing fatal injury to lice and lice eggs infesting said hair, placing said lice comb in a group of hairs, moving said apparatus with the lice comb through the group of hairs, thereby causing separation of the lice and lice eggs from the hairs and at the same type systemic fatal injury to said lice and lice eggs located in said group of hairs.

* * * * *